US011183321B2

(12) United States Patent
Ikeda et al.

(10) Patent No.: US 11,183,321 B2
(45) Date of Patent: Nov. 23, 2021

(54) POWDER MAGNETIC CORE WITH SILICA-BASED INSULATING FILM, METHOD OF PRODUCING THE SAME, AND ELECTROMAGNETIC CIRCUIT COMPONENT

(71) Applicant: Diamet Corporation, Niigata (JP)

(72) Inventors: Hiroaki Ikeda, Saitama (JP); Kazunori Igarashi, Hitachinaka (JP)

(73) Assignee: Diamet Corporation, Niigata (JP)

( * ) Notice: Subject to any disclaimer, the term of this patent is extended or adjusted under 35 U.S.C. 154(b) by 175 days.

(21) Appl. No.: 16/089,052

(22) PCT Filed: Mar. 30, 2017

(86) PCT No.: PCT/JP2017/013329
§ 371 (c)(1),
(2) Date: Sep. 27, 2018

(87) PCT Pub. No.: WO2017/170901
PCT Pub. Date: Oct. 5, 2017

(65) Prior Publication Data

US 2019/0131040 A1 May 2, 2019

(30) Foreign Application Priority Data

Mar. 31, 2016 (JP) ..... JP2016-073636
Mar. 29, 2017 (JP) ..... JP2017-066237

(51) Int. Cl.
*H01F 1/33* (2006.01)
*B22F 1/02* (2006.01)
(Continued)

(52) U.S. Cl.
CPC ..... *H01F 1/33* (2013.01); *B22F 1/02* (2013.01); *B22F 3/24* (2013.01); *H01F 1/14766* (2013.01);
(Continued)

(58) Field of Classification Search
None
See application file for complete search history.

(56) References Cited

U.S. PATENT DOCUMENTS

2011/0156850 A1* 6/2011 Okamoto ..... H01F 41/0246 335/297
2015/0228387 A1 8/2015 Urushihara et al.

FOREIGN PATENT DOCUMENTS

CN 1934289 A 3/2007
CN 103959405 A 7/2014
(Continued)

OTHER PUBLICATIONS

International Search Report dated Jun. 27, 2017 for the corresponding PCT International Patent Application No. PCT/JP2017/013329.
(Continued)

*Primary Examiner* — Ronak C Patel
(74) *Attorney, Agent, or Firm* — Leason Ellis LLP

(57) ABSTRACT

The present invention relates to a powder magnetic core with silica-based insulating film having a structure in which a plurality of Fe-based soft magnetic powder particles having surfaces coated with a silica-based insulating film are joined with each other through a grain boundary layer made of the silica-based insulating film. Fe diffused from the Fe-based soft magnetic powder particles is contained in the grain boundary layer and the grain boundary layer contains an oxide of each of Fe and Si or a composite oxide of Fe and Si.

5 Claims, 16 Drawing Sheets

(51) Int. Cl.

| | |
|---|---|
| ***H01F 1/147*** | (2006.01) |
| ***H01F 27/255*** | (2006.01) |
| ***H01F 41/02*** | (2006.01) |
| ***H01F 1/24*** | (2006.01) |
| ***H01F 3/08*** | (2006.01) |
| ***B22F 3/24*** | (2006.01) |

(52) U.S. Cl.
CPC ..... *H01F 1/24* (2013.01); *H01F 3/08* (2013.01); *H01F 27/255* (2013.01); *H01F 41/0246* (2013.01); *B22F 2301/35* (2013.01); *B22F 2998/10* (2013.01); *C22C 2202/02* (2013.01)

(56) References Cited

FOREIGN PATENT DOCUMENTS

| | | | |
|---|---|---|---|
| EP | 2219195 | A1 | 8/2010 |
| EP | 2221837 | A1 | 8/2010 |
| JP | 2006-049407 | A | 2/2006 |
| JP | 2010-251600 | A | 11/2010 |
| JP | 2011-233827 | A | 11/2011 |
| JP | 2014-019929 | A | 2/2014 |
| WO | WO-2013/108643 | A | 7/2013 |

OTHER PUBLICATIONS

Chinese Office Action dated Jul. 29, 2019 for the corresponding Chinese Patent Application No. 201780015882.0.
European Search Report dated Aug. 26, 2019 for the corresponding European Patent Application No. 17775435.5.

* cited by examiner viewing area 1 viewing area 2

FIG. 16 viewing area 3
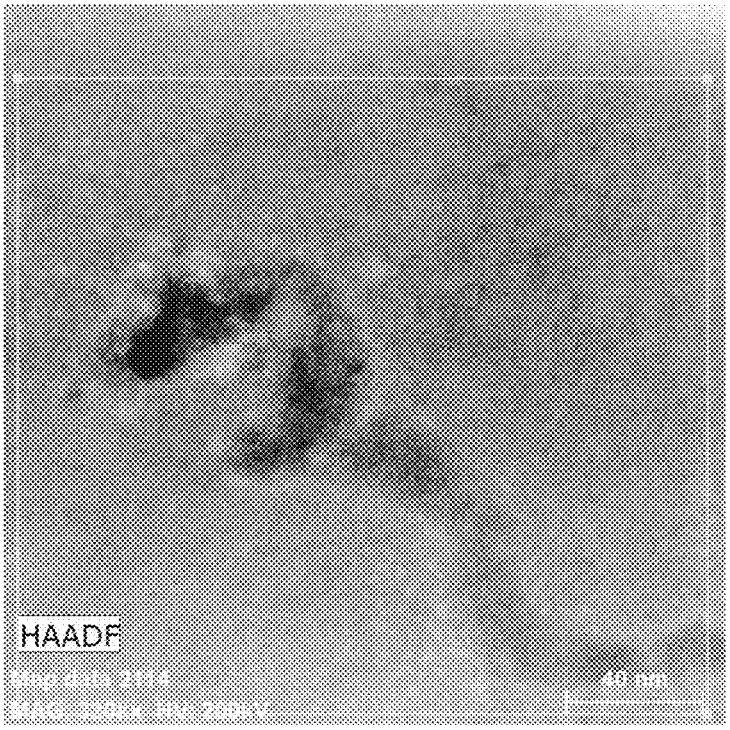
FIG. 17 viewing area 4
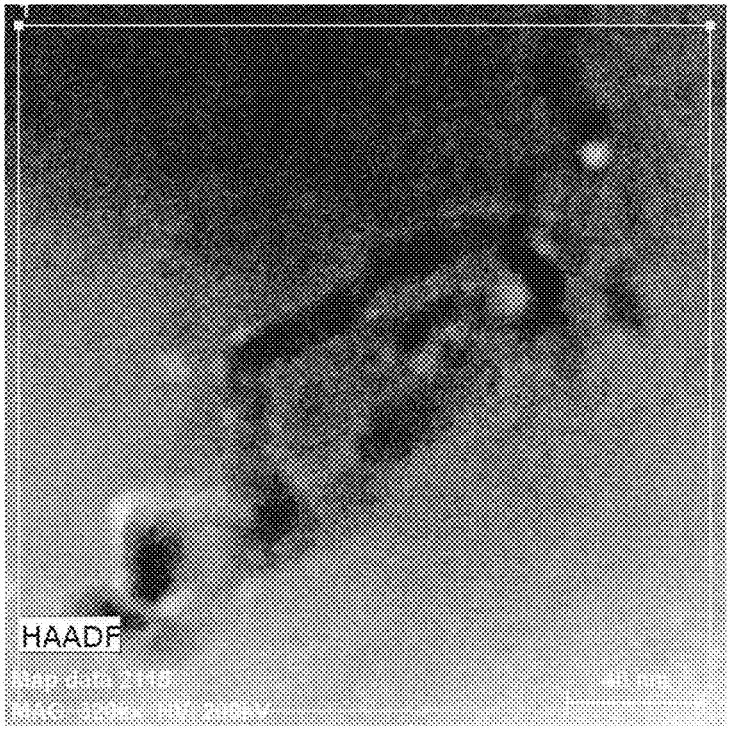

FIG. 18 viewing area 5
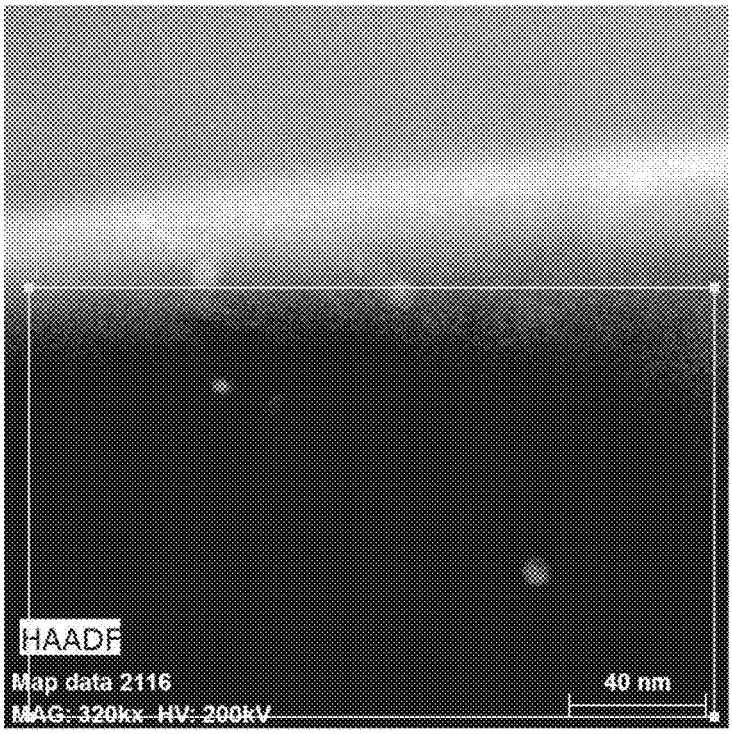
FIG. 19 viewing area 6
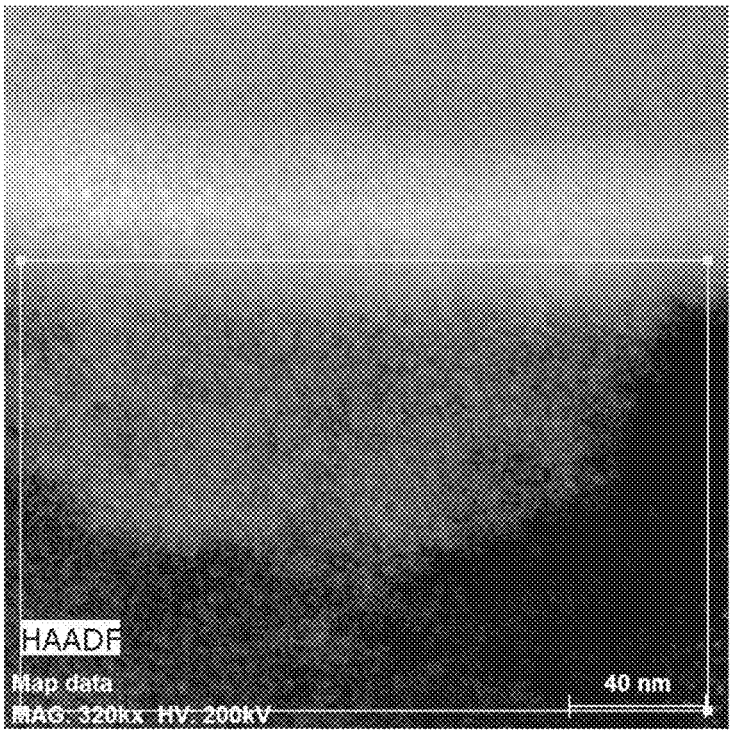

FIG. 20 viewing area 7
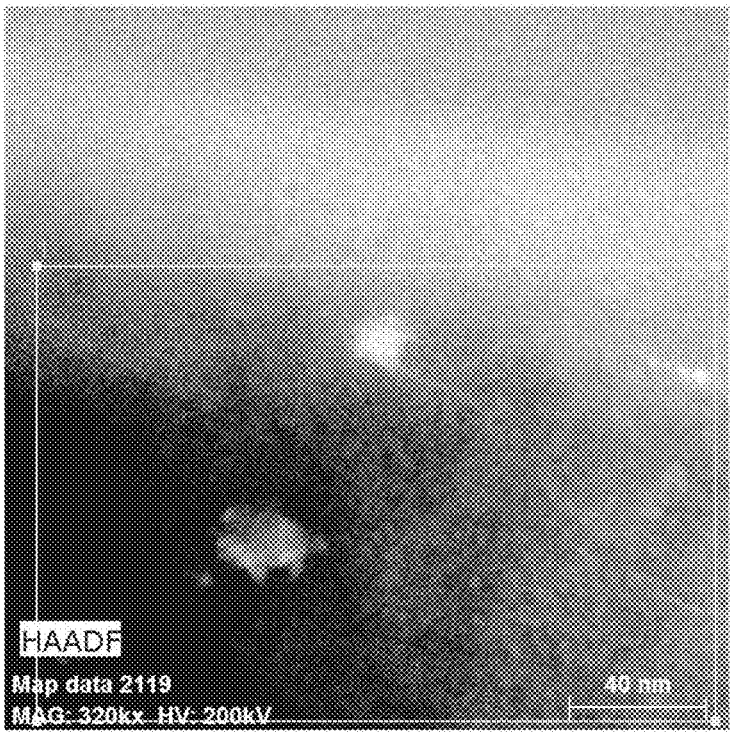
FIG. 21 viewing area 8
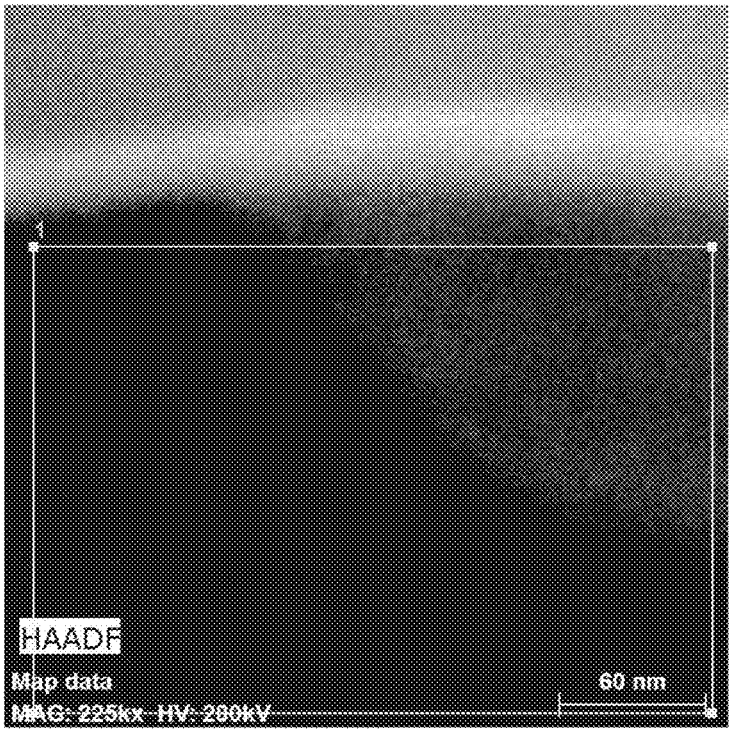

FIG. 22 viewing area 9
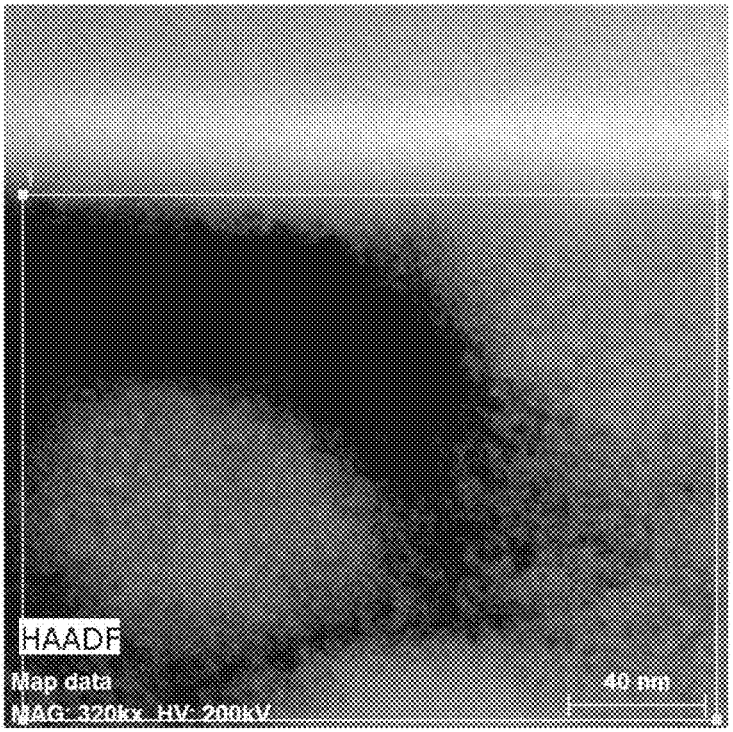
FIG. 23 viewing area 10
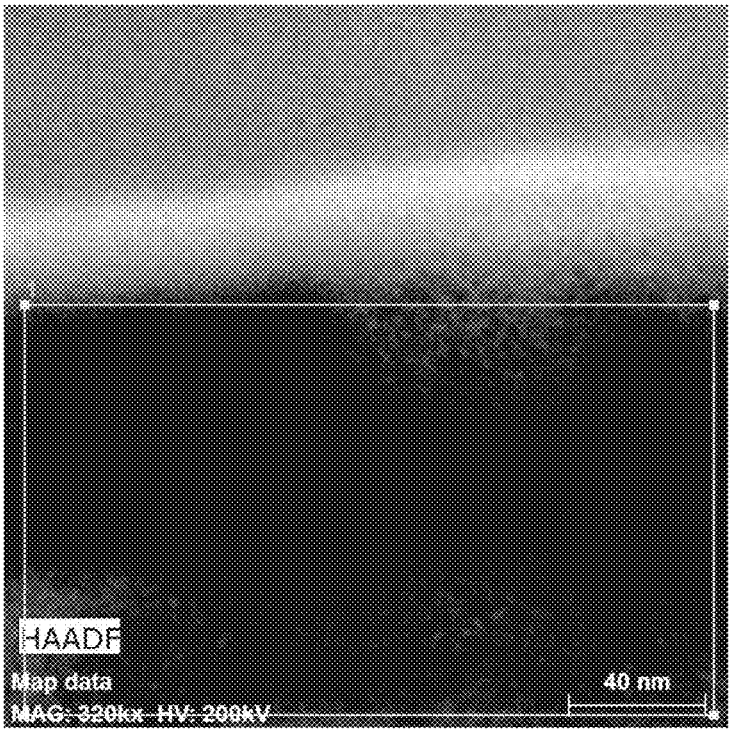

before heating after heating before heating after heating

POWDER MAGNETIC CORE WITH SILICA-BASED INSULATING FILM, METHOD OF PRODUCING THE SAME, AND ELECTROMAGNETIC CIRCUIT COMPONENT

CROSS-REFERENCE TO RELATED PATENT APPLICATIONS

This application is a U.S. National Phase Application under 35 U.S.C. § 371 of International Patent Application No. PCT/JP2017/013329, filed Mar. 30, 2017, and claims the benefit of Japanese Patent Application No. 2016-073636, filed Mar. 31, 2016, and Japanese Patent Application No. 2017-066237, Mar. 29, 2017, all of which are incorporated herein by reference in their entirety. The International Application was published in Japanese on Oct. 5, 2017 as International Publication No. WO/2017/170901 under PCT Article 21(2).

FIELD OF THE INVENTION

The present invention relates to a powder magnetic core with silica-based insulating film having high resistance and a high magnetic flux density, a method of producing the same, and an electromagnetic circuit component.

BACKGROUND OF THE INVENTION

In the related art, as a magnetic core of a motor core, an actuator, or a magnetic sensor, a powder magnetic core obtained by adding a resin powder to a soft magnetic powder such as an Fe powder or an Fe-based alloy powder to prepare a mixture powder, and compression-molding the mixture powder, and then performing a heat treatment is known.

When a powder magnetic core is produced using the soft magnetic powder, since a specific resistance is low in a soft magnetic powder alone, a measure for preventing sintering between soft magnetic powders by covering a surface of the soft magnetic powder with an insulating film or adding an organic compound or an insulating material and increasing specific resistance is being adopted. For example, in this type of powder magnetic core, in order to reduce an eddy current loss, a structure in which the surface of the soft magnetic powder is covered doubly with a lower layer insulating film containing a non-ferrous metal and an upper layer insulating film containing an inorganic compound, molding is performed and a heat treatment is performed is known.

As an example of the powder magnetic core, a powder magnetic core obtained when a phosphate coating is formed on the surface of the soft magnetic powder, and then a silicone resin is added thereto as a binder and mixed to prepare a silicone resin-coated soft magnetic powder, and compression molding is performed and a heat treatment is performed is known.

This powder magnetic core (composite soft magnetic material) has a structure in which soft magnetic powder particles are joined with each other with a silicone resin coating therebetween, and insulation between the soft magnetic powder particles is secured by the resin coating layer, and thus an eddy current loss can be reduced.

In addition, in order to obtain an example of this type of powder magnetic core (composite soft magnetic material), a technology in which a primer treatment is performed on the surface of a phosphate coating iron powder, a fluororesin powder is added to the iron powder after the primer treatment and mixing is performed to produce a mixture powder, the mixture powder is compression-molded, and a heat treatment is then performed, and thereby a composite soft magnetic material is obtained is proposed (refer to Japanese Unexamined Publication No. 2006-049407). The primer treatment is a treatment in which a solution in which one or more of a polyethersulfone, a polyamide imide, a polyimide, and a silicone resin, and a polytetrafluoroethylene are dissolved or dispersed is applied to the surface of the phosphate coating iron powder and dried.

Technical Problem

Incidentally, with reductions in size of electronic devices and heightening of performance, electromagnetic parts for electronic devices need to have more excellent material properties, and it is necessary for electromagnetic parts not to cause problems in actual use states. When soft magnetic materials used for such electromagnetic parts are studied, a powder magnetic core produced using a mixture powder in which a soft magnetic powder is covered with an insulating resin typified by a silicone resin has problems that the heat resistance can easily be insufficient and the specific resistance is not sufficiently increased. For example, when calcination is performed at a high temperature of 500 to 600° C., since the insulating resin deteriorates, there are problems in that it is difficult to favorably insulate soft magnetic powder particles from each other, and the specific resistance decreases.

The present invention has been made in view of the above problems, and an object of the present invention is to provide a powder magnetic core with silica-based insulating film which has more excellent heat resistance than a powder magnetic core using a soft magnetic powder covered with a silicone resin and can increase specific resistance, and a method of producing the same.

SUMMARY OF THE INVENTION

Solution to Problem (1) In order to achieve the above object, there is provided a powder magnetic core with silica-based insulating film having a structure in which p Fe-based soft magnetic powder particles having surfaces coated with a silica-based insulating film are joined with each other through a grain boundary layer made of the silica-based insulating film, wherein Fe diffused from the Fe-based soft magnetic powder particles is contained in the grain boundary layer, and the grain boundary layer contains an oxide of each of Fe and Si or a composite oxide of Fe and Si.

It is possible to provide the powder magnetic core having a silica-based insulating film which is formed of an oxide containing Fe diffused from soft magnetic powder particles and having high specific resistance, high material strength, and excellent heat resistance.

(2) In the powder magnetic core with silica-based insulating film of the present invention, preferably, a ratio of Fe is 0.1 to 6.0 at % with respect to a total amount of Fe, Si and O in the grain boundary layer.

When a content of Fe diffused in the silica-based insulating film, is 0.1 to 6.0 at %, a powder magnetic core having high specific resistance, high material strength, and excellent heat resistance is obtained.

In the grain boundary layer which is a calcined product of the silica sol-gel film, pores of an atomic level are generated according to calcination of a film component containing Si present in the grain boundary layer, and Fe diffused from soft magnetic powder particles is caught in the pores of an atomic level. Therefore, the calcined product of the silica sol-gel film, is formed of a firm oxide in which Fe diffused from soft magnetic powder particles is incorporated. As a result, a powder magnetic core having high specific resistance and excellent heat resistance is obtained.

When Fe is contained in the grain boundary layer, binding between soft magnetic powder particles is reinforced. When an amount of Fe present in the grain boundary layer exceeds 6.0 at %, the strength of the powder magnetic core is gradually improved, but the heat resistance decreases accordingly, and the specific resistance decreases. When an amount of Fe present in the grain boundary layer is 0.1 to 6.0 at %, it is possible to improve the material strength and maintain heat resistance and high specific resistance.

(3) In the powder magnetic core with silica-based insulating film of the present invention, preferably, a phosphate coating layer is formed on the surfaces the plurality of Fe-based soft magnetic powder particles, and the silica-based insulating film is formed outside of the phosphate coating layer.

In the structure, since the plurality of soft magnetic powder particles in which surfaces of soft magnetic powder particles are coated with a phosphate film are joined with each other with the grain boundary layer therebetween, it is possible to further increase the specific resistance.

(4) In the powder magnetic core with silica-based insulating film of the present invention, preferably, the silica-based insulating film is provided in such a way that the silica-based insulating film directly covers the surfaces of the plurality of Fe-based soft magnetic powder particles.

(5) In the powder magnetic core with silica-based insulating film of the present invention, preferably, 0.2 to 50 area % of spotty or irregularly shaped $SiO_2$ rich fine particles which are able to be detected in an SEM reflected electron image under an observation condition of an acceleration voltage of 1 kV are contained in the grain boundary layer.

When an amount of $SiO_2$ rich fine particles present in the grain boundary layer exceeds 50 area %, the moldability of silica-based insulation-coated soft magnetic powder particles tends to decrease.

If an amount of $SiO_2$ rich fine particles present in the grain boundary layer is less than 0.2 area %, when a molded body contracts during a heat treatment step, even if there are few insulation coating defects (Fe exposed parts) in the surface of the silica-based insulation-coated soft magnetic powder particles, Fe exposed parts may come in contact with the surface of the soft magnetic powder particles and conduct electricity.

(6) An electromagnetic circuit component of another aspect of the present invention (hereinafter referred to as an "electromagnetic circuit component of the present invention") formed of the powder magnetic core with silica-based insulating film according to any one of aspects of the present invention described above.

According to the electromagnetic circuit component of the present invention formed of the powder magnetic core with silica-based insulating film, it is possible to provide an electromagnetic circuit component which has excellent heat resistance, high strength, and of which specific resistance at high temperatures is unlikely to be lowered.

(7) A method of producing a powder magnetic core with silica-based insulating film having a structure in which a plurality of Fe-based soft magnetic powder particles having surfaces coated with a silica-based insulating film are joined with each other through a grain boundary layer made of the silica-based insulating film, wherein Fe diffused from the Fe-based soft magnetic powder particles is contained in the grain boundary layer, and the grain boundary layer contains an oxide of each of Fe and Si or a composite oxide of Fe and Si, the method including the steps of: preparing a silica sol-gel coating solution by adding a silicone resin and a Si alkoxide to a solvent and mixing by stirring; obtaining silica sol-gel-coated soft magnetic powder particles by applying the silica sol-gel coating solution to Fe-based soft magnetic powder particles; mixing a plurality of silica sol-gel-coated soft magnetic powder particles to be subjected to compression molding to obtain a green compact; and heating the green compact.

When a silicone resin and a Si alkoxide are added to a solvent and sufficiently mixed and stirred, it is possible to obtain a silica sol-gel coating solution in which the solvent and the Si alkoxide are mixed together and the silicone resin is dissolved (finely dispersed). When the plurality of silica sol-gel-coated soft magnetic powder particles in which the silica sol-gel coating solution is applied to soft magnetic powder particles are mixed together and compression-molded and calcined, it is possible to obtain a powder magnetic core having a structure in which soft magnetic powder particles are joined with each other with the grain boundary layer formed of the calcined product of the silica sol-gel coating solution therebetween. In the grain boundary layer formed of the calcined product of the silica sol-gel coating solution, an organic content in the film component is partially burned during calcination, and there are pores of an atomic level formed after a polymerization reaction is caused. Fe diffused from the soft magnetic powder particles during calcination is incorporated into the pores of an atomic level, and a grain boundary layer having excellent heat resistance and high strength is generated.

(8) In the production method of the present invention, a phosphate coating may be applied on the soft magnetic powder particles before the silica sol-gel coating solution is applied.

(9) In addition, in the production method of the present invention, preferably, a silicone resin powder is added when the plurality of silica sol-gel coated soft magnetic powders are mixed together.

(10) In the method of producing a powder magnetic core with silica-based insulating film of the present invention according to any one of aspects of the present invention described above, it is possible that the grain boundary layer in which a ratio of Fe is 0.1 to 6.0 at % in a total amount of Fe, Si and O is obtained.

(11) In the method of producing a powder magnetic core with silica-based insulating film of the present invention according to any one of aspects of the present invention described above, it is preferable that a grain boundary layer in which 0.2 to 50 area % of spotty or irregularly shaped $SiO_2$ rich fine particles which are able to be detected in an SEM reflected electron image under an observation condition of an acceleration voltage of 1 kV are contained is obtained.

Advantageous Effects of Invention

According to the present invention, it is possible to provide a powder magnetic core having excellent heat resistance which has a structure in which a plurality of Fe-based soft magnetic powder particles are joined with each other through a grain boundary layer formed of a silica-based insulating film therebetween, the grain boundary layer is formed of an oxide of each of Fe and Si or a composite oxide of Fe and Si, Fe diffused from the soft magnetic powder particles is contained in the grain boundary layer, and the grain boundary layer is firmly connected to the soft magnetic powder particles.

In addition, the grain boundary layer covering the soft magnetic powder particles is formed of an oxide of each of Fe and Si or a composite oxide, and the insulation property is excellent even if a heat treatment is performed at a high temperature, and thereby it is possible to provide a powder magnetic core having high specific resistance.

BRIEF DESCRIPTION OF THE DRAWINGS

FIG. 4(A) is a diagram showing a state in which a silicone resin is added to a solvent, FIG. 4(B) is a diagram showing a state in which TEOS is added to a solvent, FIG. 4(C) is a diagram showing a state in which water and a catalyst are added, and FIG. 4(D) is a diagram showing a sol-gel coating solution (a coating solution for forming a silica-based insulating film).

FIG. 16 is a section structure photo obtained by performing EDS analysis on an area indicated by the reference numeral 3 in the sample shown in FIG. 12.

FIG. 17 is a section structure photo obtained by performing EDS analysis on an area indicated by the reference numeral 4 in the sample shown in FIG. 12.

FIG. 18 is a section structure photo obtained by performing EDS analysis on an area indicated by the reference numeral 5 in the sample shown in FIG. 12.

FIG. 19 is a section structure photo obtained by performing EDS analysis on an area indicated by the reference numeral 6 in the sample shown in FIG. 13.

FIG. 20 is a section structure photo obtained by performing EDS analysis on an area indicated by the reference numeral 7 in the sample shown in FIG. 13.

FIG. 21 is a section structure photo obtained by performing EDS analysis on an area indicated by the reference numeral 8 in the sample shown in FIG. 13.

FIG. 22 is a section structure photo obtained by performing EDS analysis on an area indicated by the reference numeral 9 in the sample shown in FIG. 13.

FIG. 23 is a section structure photo obtained by performing EDS analysis on an area indicated by the reference numeral 10 in the sample shown in FIG. 13.

DETAILED DESCRIPTION OF THE INVENTION

The present invention will be described below in detail, but the present invention is not limited to embodiments to be described below.

Figure 1:
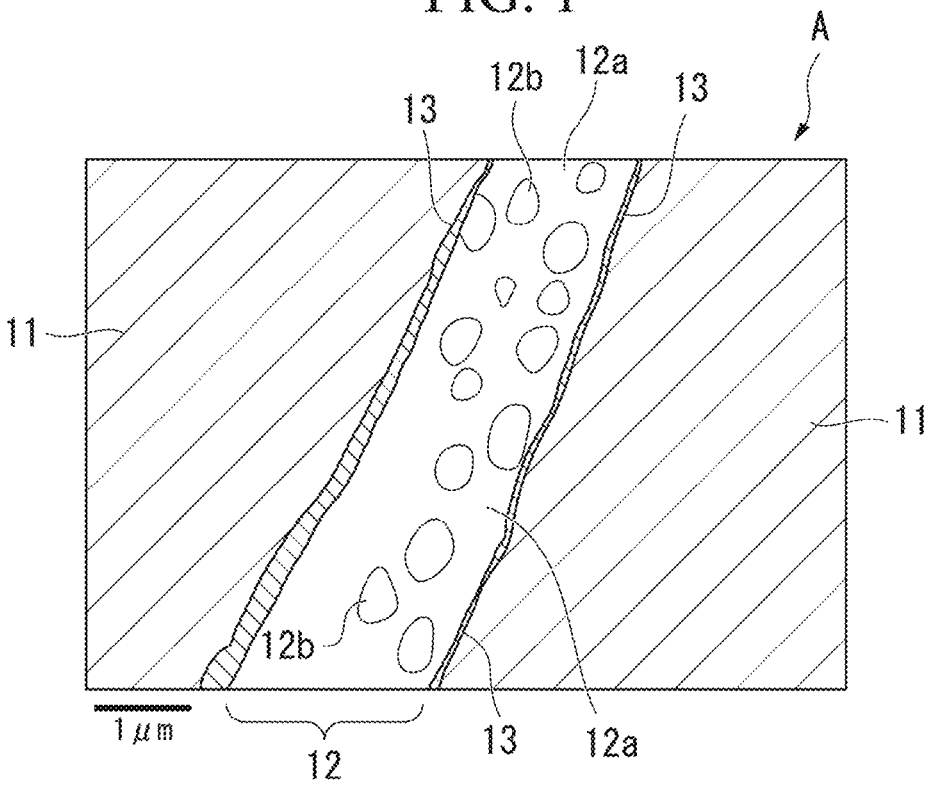
FIG. 1 is an enlarged schematic view showing a compositional structure of a powder magnetic core with silica-based insulating film according to the present invention.

FIG. 1 is a schematic diagram showing an example of a compositional structure of a powder magnetic core of a first embodiment according to the present invention. A powder magnetic core A of this embodiment has a configuration in which a plurality of soft magnetic powder particles 11 is joined with each other through a grain boundary layer 12 therebetween. In addition, a base film 13 is formed on an outer circumference of each of the soft magnetic powder particles 11.

FIG. 1 shows only a part of the two soft magnetic powder particles 11 and a part of the grain boundary layer 12 interposed therebetween. The powder magnetic core A is molded into a desired shape by separately connecting the plurality of soft magnetic powder particles 11 to each other with the grain boundary layer 12 therebetween, and integrating them.

Figure 2:
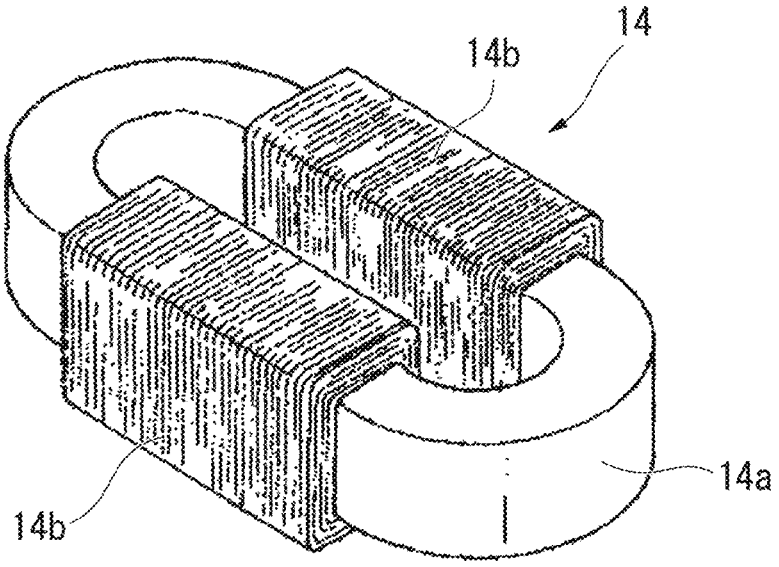
FIG. 2 is a perspective view showing an example in which a powder magnetic core with silica-based insulating film according to the present invention is applied to a reactor core.

As an example of application of the powder magnetic core A to an electromagnetic part, a reactor core 14*a* having a racetrack shape and an annular shape in a plan view shown in FIG. 2 can be exemplified. Coil parts 14*b* and 14*b* formed by winding are formed on linear parts of the reactor core 14*a* to constitute a reactor 14.

The reactor core 14*a* shown in FIG. 2 is obtained by mixing a plurality of silica-based insulation-coated soft magnetic powders to be described below and a binder, putting the mixture into a mold, compression-molding the mixture into a desired shape using the mold, and calcining the mixture after molding.

The soft magnetic powder particles 11 are, for example, pure iron powder particles, and pure iron powder particles 11 having an average particle size (D50) in a range of 5 to 500 μm are preferably contained as a main component. The reason for this is inferred to be that, when the average particle size is too smaller than 5 μm, the compressibility of the pure iron powder particles decreases, a volume proportion of the pure iron powder particles decreases, and thus a value of a magnetic flux density tends to decreases, and on the other hand, when the average particle size is too larger than 500 μm, an eddy current inside the pure iron powder particles increases, and permeability at high frequencies decreases.

Here, the average particle size of pure iron-based soft magnetic powder particles is a particle size obtained by measurement using a laser diffraction method.

The base film 13 is made of a phosphate film, for example, an iron phosphate film, a zinc phosphate film, a manganese phosphate film, or a calcium phosphate film.

Here, particles constituting the soft magnetic powder particles 11 are not limited to the pure iron powder particles. Of course, soft magnetic alloy powder particles such as Fe—Si based iron base soft magnetic alloy powder particles, Fe—Si—Al based iron base soft magnetic alloy powder particles, Fe—Ni based alloy powder particles, Fe—Co based iron base soft magnetic alloy powder particles, Fe—Co—V based iron base soft magnetic alloy powder particles, Fe—P based iron base soft magnetic alloy powder particles, and Fe—Cr based Fe-based alloy powder particles can be generally widely applied.

The grain boundary layer 12 is formed of a calcined product of a silica-based insulation coating produced by a method to be described below. The powder magnetic core A is obtained by applying a coating solution (to be described below) in which a silicone resin and TEOS (tetraethoxysilane: $Si(OC_2H_5)_4$: a Si alkoxide) are dissolved or dispersed in a solvent on a soft magnetic powder with a phosphate film, drying the powder, and then putting a required amount of the powder into a mold for molding together with a lubricant, molding the mixture into a desired shape, and then performing a heat treatment thereon.

A step of producing the powder magnetic core A will be described below in detail.

Figure 3:
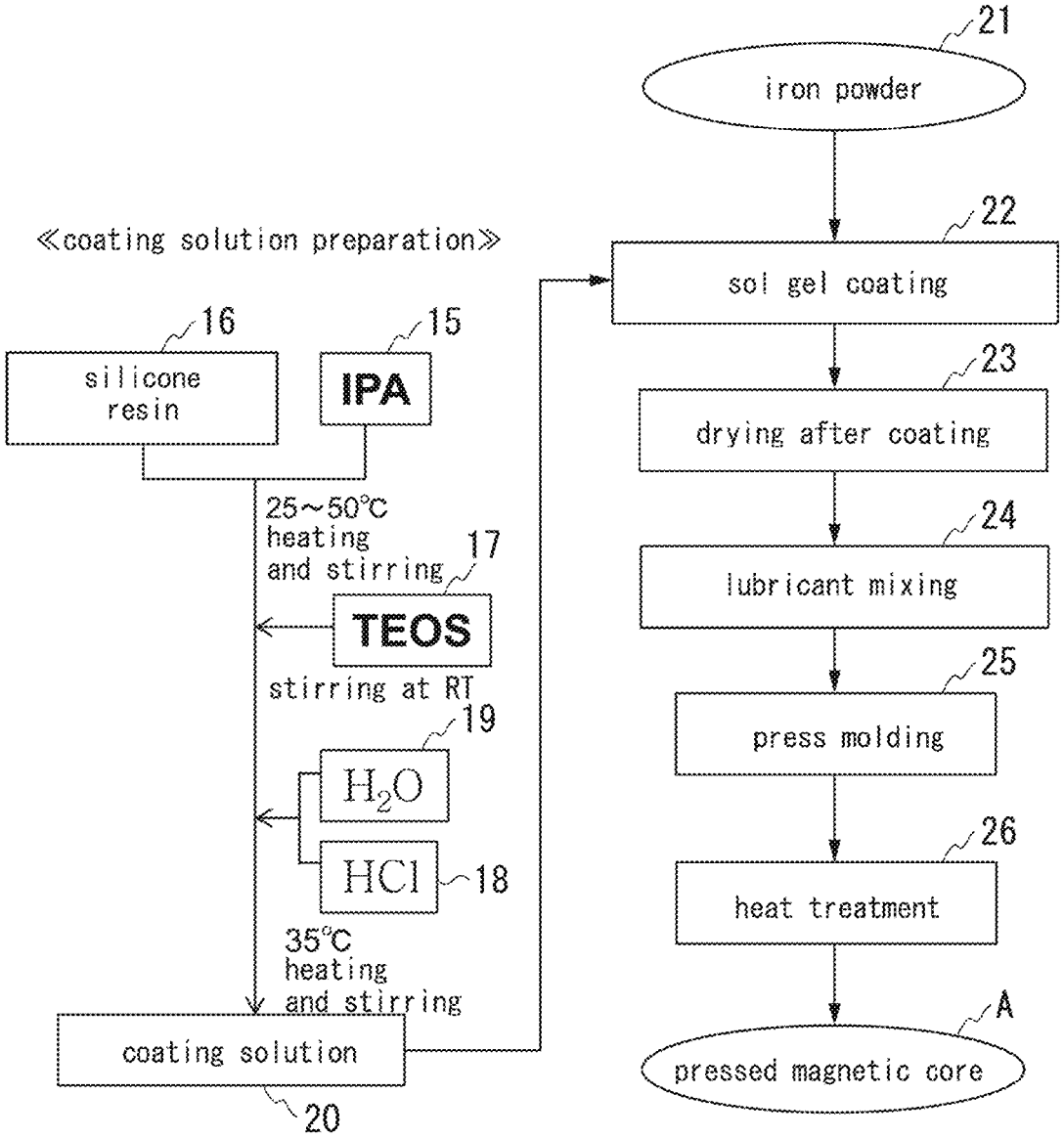
FIG. 3 is an explanatory diagram showing an example of a step for producing a powder magnetic core with silica-based insulating film according to the present invention.
Figure 4:
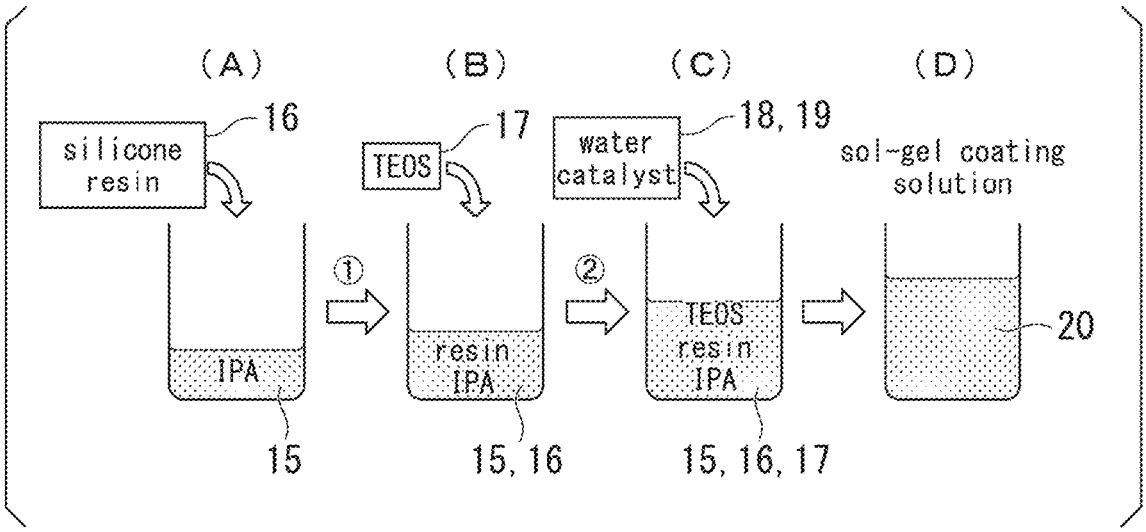
FIG. 4 shows explanatory diagrams of examples of a step of mixing a silicone resin and TEOS.

In order to produce the powder magnetic core A, first, a coating solution to be applied to the outer circumference of the soft magnetic powder is produced. In order to produce the coating solution, a solvent 15 such as IPA (2-propanol) as shown in FIG. 3 and FIG. 4(A) is heated to a temperature of about 25 to 50° C., while stirring the solvent about 2 to 12 hours, and a silicone resin 16 is dissolved in the solvent 15 (dissolving step).

The solvent 15 used in this dissolving step may be ethanol, 1-butanol, etc. in addition to IPA.

There are problems in that, when the heating temperature is lower than 25° C., the silicone resin 16 may be insufficiently dissolved, and when the heating temperature exceeds 50° C., the solvent may easily evaporate, and the silicone resin 16 is not sufficiently dispersed in the solvent.

A dissolution and stirring time is preferably 2 hours or longer. However, when the dissolution and stirring time is short, dissolution tends to be insufficient, and even if a dissolution and stirring time of longer than 24 hours is set, time is wasted. Therefore, a dissolution time is preferably about 2 to 12 hours.

As an amount of the silicone resin 16 dissolved in the solvent 15, preferably, about 20 g to 350 g of the silicone resin is dissolved in 1 L of the solvent.

After the silicone resin 16 is sufficiently dissolved in the solvent 15, as shown in FIG. 3 and FIG. 4(B), TEOS (tetraethoxysilane: $Si(OC_2H_5)_4$) 17 is added to the solvent 15, mixed, and sufficiently stirred (TEOS adding step).

An amount of TEOS 17 mixed in is preferably [solvent]/[TEOS]=about 4 to 15, and preferably in a range of 7 to 13, according to a molar ratio of the solvent. A temperature at which TEOS 17 is mixed with the solvent 15 may be room temperature, and heating may be performed in the same temperature range as the case where the silicone resin 16 described above is dissolved.

After TEOS 17 is added, as shown in FIG. 3 and FIG. 4(C), hydrochloric acid 18 as an acid catalyst and water 19 are added to the solvent, and stirring is then performed at 25 to 50° C., for example, 35° C., for 4 hours or longer, for example, about 4 to 24 hours (catalyst adding step). When the hydrochloric acid 18 is added, a hydrolysis reaction is preferentially caused, and a condensation polymerization reaction is caused. As the acid catalyst used here, nitric acid, acetic acid, formic acid, phosphoric acid, or the like can be used in addition to hydrochloric acid.

According to the above step, a sol-gel coating solution 20 shown in FIG. 3 and FIG. 4(D) can be obtained. The sol-gel coating solution 20 is in a state in which fine particles of a fine silicone resin that cannot be visually observed in a liquid in which TEOS is added in a solvent are dispersed.

After the coating solution 20 is produced, as shown in the step in FIG. 3, the coating solution 20 is put into a fluid mixer such as a Henschel mixer together with a soft magnetic powder 21 with a phosphate film, and the coating solution 20 with a predetermined thickness is applied to the outer circumference of the soft magnetic powder (a coating step 22).

Here, the soft magnetic powder 21 used in the coating step 22 may be the soft magnetic powder 21 without a phosphate film 13, and the phosphate film 13 may be omitted.

A heating temperature during mixing is set to 85° C. to 105° C., for example 95° C. After mixing under a reduced pressure is completed, heating is performed at a temperature of about 175 to 250° C., for example, 200° C., for about 10 minutes, the coating solution on the outer circumference of the soft magnetic powder is dried, and a coating powder for molding having a structure in which the outer circumference of the soft magnetic powder is covered with a dry film of the coating solution can be obtained (a drying step 23).

During the above drying, when drying is performed at a temperature of lower than 175° C., since a drying time is long, the production efficiency deteriorates, and when drying is performed at a temperature of higher than 250° C., there is a problem of cracks easily occurring in the film.

Next, a silicone resin powder with a proportion of (0 mass % to 0.9 mass %), for example, a proportion of 0.03 mass % or 0.09 mass %, or 0.18 mass % is mixed together with the coating powder and thereby a raw material mixture powder for molding is obtained. In the raw material mixture powder for molding, a wax type lubricant with a proportion of (0 mass % to 0.8 mass %), for example, 0.4 mass % or 0.6 mass %, is mixed (a mixing step 24).

The obtained raw material mixture powder is put into a mold of a press molding machine, and is compression-molded into a desired shape, for example, an annular ring, a rod shape, or a disk shape (a molding step 25).

A pressurizing pressure during molding is, for example, a pressure of about 700 to 1,570 MPa, for example, 790 MPa, and compression molding can be performed by warm molding at 80° C.

According to a heat treatment step 26 in which the obtained molded body is heated and calcined in a non-oxidizing atmosphere such as a vacuum atmosphere or a nitrogen gas atmosphere and in a temperature range of 500° C. to 900° C., for example, 650° C., for about several tens of minutes to several hours, for example, about 30 minutes, a desired powder magnetic core A having a structure in which the soft magnetic powder particles 11 composed of a plurality of soft magnetic powders are joined with each other with the grain boundary layer 12 therebetween can be obtained.

The powder magnetic core A obtained by the production method described above has a structure in which a silicone resin is sufficiently dissolved in the above solvent, a dried product of the coating solution in which TEOS is sufficiently dispersed is consolidated, and the plurality of soft magnetic powder particles 11 are joined with each other with the grain boundary layer 12 therebetween generated by calcining that layer.

The grain boundary layer 12 obtained by sufficiently dissolving a silicone resin in a solvent and calcining a dried product of a sol-gel coating solution (coating solution for forming a silica-based insulating film) in which TEOS is sufficiently dispersed is assumed to be a composite oxide layer in which a Si—O framework derived from the sol-gel coating solution and a resin framework derived from the silicone resin are composited in the layer.

If the above sol-gel coating solution (coating solution for forming a silica-based insulating film) 20 is used, the silicone resin and TEOS are sufficiently stirred and mixed in the solvent, an acid catalyst and water are added thereto, and a hydrolysis reaction and a condensation polymerization reaction are promoted. Then, when the sol-gel coating solution containing a silicone resin and TEOS (coating solution for forming a silica-based insulating film) is used, the silicone resin which is a resin is inevitably present between molecules, this is partially burned during calcination, and pores of an atomic level are generated in the grain boundary layer. Here, Fe is diffused from Fe-based soft magnetic powder particles during calcination, and iron atoms are captured in pores of an atomic level. As a result, the grain boundary layer 12 having a structure in which Fe is diffused in a Si composite oxide is generated, and as a result of the grain boundary layer 12, the high strength powder magnetic core A in which the soft magnetic powder particles 11 are firmly connected can be obtained. Here, it is confirmed that Fe is diffused into the grain boundary layer 12 from analysis of samples of examples to be described below.

In addition, when the soft magnetic powder particles 11 surrounding the grain boundary layer 12 are used, even if the temperature is raised to a high temperature of 500° C. to 650° C. in a reduced pressure and inert gas atmosphere, microcrystals of iron oxide are unlikely to be generated on the circumferential surface of the soft magnetic powder particles 11, and as a result of this, even in the powder magnetic core A calcined at a high temperature, it is possible to provide the powder magnetic core A in which a reduction in specific resistance is minimized. That is, since precipitation of microcrystals of iron oxide on the circumferential surface of the obtained soft magnetic powder particles 11 is low, it is possible to maintain high specific resistance even at high temperatures. The fact that precipitation of microcrystals of iron oxide is low when the temperature is raised in a reduced pressure and inert gas atmosphere means that the number of defects present in the film before calcining is small.

Figure 7:
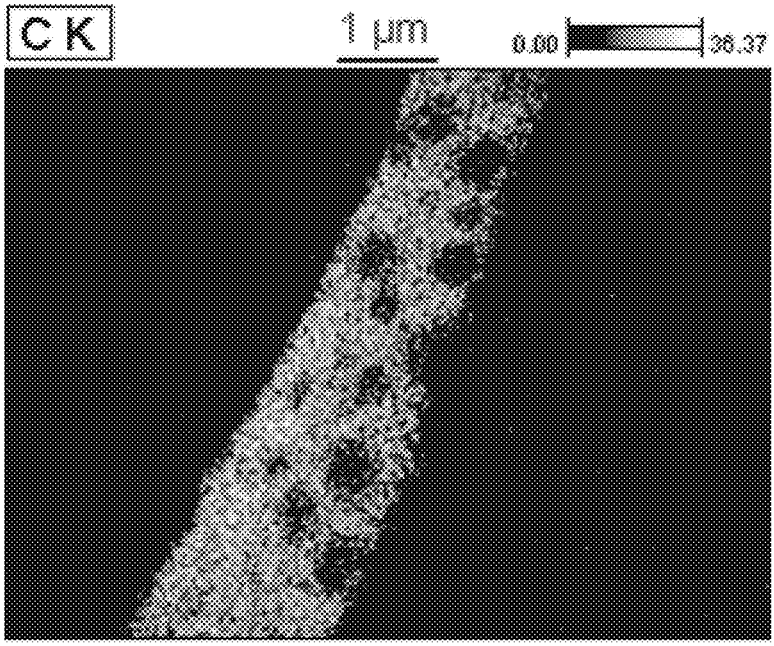
FIG. 7 is an analysis photo showing a carbon (C) concentration measurement result of the same cross-sectional structure according to SEM-EDS plane analysis.

The grain boundary layer 12 is composed of a base layer 12*a* in which C is contained in an oxide of each of Fe and Si or a composite oxide of Fe and Si, and $SiO_2$ rich spotty or irregularly shaped fine particles 12*b* that are dispersed in the grain boundary layer 12. The $SiO_2$ rich fine particles 12*b* are in a low C concentration range from a C distribution condition in FIG. 7 showing a test result of an example to be described below.

As will be described below in detail in an example to be described below, the $SiO_2$ rich fine particles 12*b* are spotty or irregularly shaped $SiO_2$ rich fine particles that can be found in an SEM reflected electron image under an observation condition of an acceleration voltage of 1 kV and a magnification of 50,000 in the grain boundary layer.

In addition, in the present embodiment, preferably, the $SiO_2$ rich fine particles 12*b* are contained in a range of 0.2 to 50 area % with respect to the total area of the grain boundary layer 12 in the viewing area during observation.

When the $SiO_2$ rich fine particles 12*b* present in the grain boundary layer 12 exceed 50 area % (average value), there is a risk of moldability of the silica-based insulation-coated soft magnetic powder particles deteriorating. Thus, there are risks of the strength of a material as the powder magnetic core decreasing and practicality deteriorating. For example, since there is a risk of the strength of the powder magnetic core A being insufficient, it is not preferable for the $SiO_2$ rich fine particles 12*b* to be contained at an amount exceeding 50 area % (average value) in the grain boundary layer in consideration of the strength.

If a proportion of the $SiO_2$ rich fine particles 12*b* present in the grain boundary layer 12 is less than 0.2 area % (average value), when the molded body contracts during the heat treatment step, even if there are few insulation coating defects (Fe exposed parts) in the surface of the silica-based insulation-coated soft magnetic powder particles, it is not possible to prevent Fe exposed parts on the surface of soft magnetic powder particles from coming in contact with each other and conducting electricity. That is, since there is a risk of the specific resistance of the powder magnetic core A of the silica-based insulation coating being lowered, it is not preferable for a proportion of the $SiO_2$ rich fine particles 12*b* to be less than 0.2 area % (average value).

In the powder magnetic core A having the above configuration, there are a plurality of $SiO_2$ rich fine particles 12*b* in the silica-based insulation coating on the surface of silica-based insulation-coated iron powder. Thereby, iron powders in the structure of a silica-based insulation-coated iron green compact (a silica-based insulation-coated iron powder that is compressed and molded) before a heat treatment maintain an appropriate distance via the grain boundary layer 12 even if the green compact contracts during a heat treatment in a nitrogen atmosphere.

Accordingly, it can be inferred that, even if there are few Fe exposed parts on the surface of the silica-based insulation-coated iron powder, an effect of preventing iron powders in the Fe exposed parts from coming in contact with each other and conducting electricity is not obtained. That is, it is possible to maintain insulation properties of each of the plurality of soft magnetic powder particles 11 connected to each other with the grain boundary layer 12 therebetween at a high level.

Accordingly, the powder magnetic core A of the silica-based insulation coating of the present embodiment is thought to have a high specific resistance.

The powder magnetic core A produced as described above has high strength and high specific resistance. In addition, the powder magnetic core A has a specific resistance that is unlikely to be lowered even if it is heated to 500 to 650° C. and has excellent heat resistance.

In addition, in the reactor 14 in FIG. 2 to which the powder magnetic core A is applied, the specific resistance of the reactor core 14*a* is high, and high performance of the reactor 14 can be obtained.

Here, the reactor 14 is an example in which the powder magnetic core A according to the present invention is applied to an electromagnetic circuit component. Of course, the powder magnetic core A according to the present invention can be applied to various other electromagnetic circuit components. The powder magnetic core A can be applied to various electromagnetic circuit components, for example, a motor core, an actuator core, a transformer core, a choke core, a magnetic sensor core, a noise filter core, a switching power supply core, and a DC/DC converter core.

EXAMPLES

An iron-phosphate-coated iron powder in which an iron phosphate coating was applied to a pure iron powder with an average particle size of 50 μm (D50) or a pure iron powder was prepared.

A raw material mixture powder for molding for producing a first example in which, with respect to 300 g of the iron-phosphate-coated pure iron powder (soft magnetic powder), a thickness of a TEOS-derived $SiO_2$ film was 16.9 nm, and 0.2 mass % of a silicone resin was contained in a coating solution with respect to the soft magnetic powder was produced according to the following steps.

Raw material mixture powders for molding for producing a second example and producing a third example in which, with respect to 300 g of the iron-phosphate-coated pure iron powder (soft magnetic powder), a thickness of a TEOS-derived $SiO_2$ film was 33.8 nm, and 0.41 mass % of a silicone resin was contained in a coating solution with respect to the soft magnetic powder were produced according to the following steps.

A raw material mixture powder for molding for producing a fourth example in which, with respect to 300 g of the iron-phosphate-coated pure iron powder (soft magnetic powder), a thickness of a TEOS-derived $SiO_2$ film was 67.5 nm, and 0.54 mass % of a silicone resin was contained in a coating solution with respect to the soft magnetic powder was produced according to the following steps.

A raw material mixture powder for molding for producing a fifth example in which, with respect to 300 g of the pure iron powder (soft magnetic powder), a thickness of a TEOS-derived $SiO_2$ film was 33.8 nm, and 0.41 mass % of a silicone resin was contained in a coating solution with respect to the soft magnetic powder was produced according to the following steps. This powder corresponded to an example using a soft magnetic powder that is referred to as a phosphate film.

Procedures of producing raw material mixture powders for molding will be described below.

A methyl silicone resin was mixed with 2-propanol (IPA) with a liquid temperature of 45° C., and the mixture was stirred for 2 hours and dissolved, and tetraethoxysilane (TEOS) was stirred and mixed in the solution at room temperature for 4 hours.

Then, 12 NHCl was added thereto, and the mixture was stirred for 24 hours (liquid temperature of 35° C.), and thereby a silica sol-gel coating solution was obtained.

A silica sol-gel coating solution for producing the first example was obtained by mixing components in the following proportions: silicone resin: 0.61 g, IPA: 6.70 g, TEOS: 1.86 g, water: 0.32 g, 12 NHCl: 0.008 g, and a total of 9.496 g.

Silica sol-gel coating solutions for producing the second example and for producing the third example were obtained by mixing components in the following proportions: silicone resin: 1.22 g, IPA: 13.39 g, TEOS: 3.73 g, water: 0.65 g, 12 NHCl: 0.017 g, and a total of 18.992 g.

A silica sol-gel coating solution for producing the fourth example was obtained by mixing components in the following proportions: silicone resin: 1.62 g, IPA: 8.597 g, TEOS: 7.45 g, water: 1.288 g, 12 NHCl: 0.066 g, and a total of 19.021 g.

A silica sol-gel coating solution for producing the fifth example was obtained by mixing components in the following proportions: silicone resin: 1.22 g, IPA: 13.39 g, TEOS: 3.73 g, water: 0.65 g, 12 NHCl: 0.017 g, and a total of 18.992 g.

In these silica sol-gel coating solutions, the silicone resin was set to 0.20 mass % (for producing the first example), 0.41 mass % (for producing the second and third examples), 0.54 mass % (for producing the fourth example), and 0.41 mass % (for producing the fifth example) with respect to the iron powder. As the silicone resin, a grade product with a particle size of 1 mm or less was used.

A proportion of [IPA]/[TEOS] was sequentially set to 12 (for producing the first example), 12 (for producing the second and third examples), 4 (for producing the fourth example), and 12 (for producing the fifth example) according to a molar ratio in silica sol-gel coating solutions for producing the first to fifth examples.

An amount of TEOS added was computed as a thickness of a TEOS-derived $SiO_2$ film, and was converted based on a soft magnetic powder with a specific surface area of $4.0\times10^{-2}$ $m^2/g$.

A film thickness of a $SiO_2$ film derived from a TEOS sol-gel coating solution was calculated by the following formula using a specific surface area (three-point BET measurement value) and a $SiO_2$ density (a crystal physical property value of 2.65 $g/cm^3$).

Film thickness (nm) of $SiO_2$ film=substance quantity (mol) of TEOS×$SiO_2$ atomic weight (g/mol)/$SiO_2$ density ($g/cm^3$)/specific surface area ($m^2/g$) of soft magnetic powder/soft magnetic powder weight (g) (*)

Computation Example

When a weight of TEOS was 7.45 g, a specific surface area of the iron powder was $4.0\times10^{-2}$ $m^2/g$, and a weight of the iron powder was 300 g, a TEOS atomic weight of 208.1 g/mol and an $SiO_2$ atomic weight of 60.1 g/mol were put into the above computation formula (*), a film thickness of the $SiO_2$ film=7.45 (g)/208.1 (g/mol)×60.1 (g/mol)/2.65 ($g/cm^3$)/$4.0\times10^{-2}$ ($m^2/g$)/300 (g)=$6.76\times10^{-8}$ (m)=67.6 (nm)

An amount of water added was [$H_2O$]/[TEOS]=2.=>($H_2O$ mass)=(TEOS mass/(208.33 g/mol (TEOS atomic weight)))×2×18.016 g/mol ($H_2O$ Molecular Weight)

An amount of dilute hydrochloric acid added was [12 NHCl]/[TEOS]=0.025.=>[100% HCl]/[TEOS]=0.009=>(12 NHCl mass)=(TEOS mass/(208.33 g/mol(TEOS molecular weight)))×0.025×36.458 g/mol (HCl molecular weight)

Alternatively, it can be computed according to (12 NHCl mass)=(TEOS mass/(208.33 g/mol (TEOS molecular weight)))×0.009×36.458 g/mol (HCl molecular weight)×100/36.

Here, the second equation representing a 12 NHCl mass was computed by setting an HCl concentration of hydrochloric acid reagent 12 NHCl as 36%.

The silica sol-gel coating solution was applied to the iron-phosphate-coated iron powder or pure iron powder using a Henschel mixer.

⅓ (3.165 g) of 9.496 g of the coating solution obtained in the above step was supplied to the iron-phosphate-coated iron powder (300 g) that was stirred in a chamber of the Henschel mixer heated to 95° C., and drying was performed under a reduced pressure, and a series of operations in which the temperature of the iron-phosphate-coated iron powder was recovered to a coating start temperature, for example, 94° C., and then stirring and heating continued for 3 minutes were repeated. When the iron powder and the coating solution were used at the above ratio, a coating iron powder (for producing Example 1) with a thickness of a TEOS-derived $SiO_2$ film of 16.9 nm was obtained.

In the sol-gel coating on the iron powder in the Henschel mixer, when application of the sol-gel coating solution (coating solution for forming a silica-based insulating film) covering the surface of the iron powder continued in an atmosphere at 95° C. for 3 minutes during heating, whenever the coating solution was repeatedly supplied, the sol-gel coating liquid film was coated on and fixed to the iron powder without being dissolved. When the heating time was shorter than 3 minutes at 95° C., since the sol-gel coating liquid film was not fixed to the surface of the iron powder, and was easily peeled off, it is preferable to perform a treatment for 3 minutes or longer.

Next, ⅙ (3.165 g) of 18.992 g of the coating solution obtained in the above step was supplied to the iron-phosphate-coated iron powder (300 g) that was stirred in a chamber of the Henschel mixer heated to 95° C. and when the iron powder and the coating solution were used at the above ratio according to the same treatment as above, a coating iron powder with a thickness of a TEOS-derived $SiO_2$ film of 33.8 nm (for producing Examples 2 and 3) was obtained.

In addition, coating iron powders of Examples 4 and 5 were obtained by the following procedures.

⅙ (3.17 g) of 19.021 g of the coating solution obtained in the above step was supplied to the iron-phosphate-coated iron powder (300 g) that was stirred in a chamber of the Henschel mixer heated at 95° C., and when the iron powder and the coating solution were used at the above ratio according to the same treatment as above, a coating iron powder (for producing Example 4) with a thickness of a TEOS-derived $SiO_2$ film of 67.5 nm was obtained.

⅙ (3.165 g) of 18.992 g of the coating solution obtained in the above step was supplied to the pure iron powder (300 g) that was stirred in a chamber of the Henschel mixer heated to 95° C., and when the iron powder and the coating solution were used at the above ratio according to the same treatment as above, a coating iron powder (for producing Example 5) with a thickness of a TEOS-derived $SiO_2$ film of 33.8 nm was obtained.

Then, the iron-phosphate-coated iron powder covered with the sol-gel coating liquid film or pure iron powder was heated in an atmosphere at 200° C. for 0.5 hours and dried, and thereby a silica sol-gel-coated iron powder was obtained.

0.09 mass % of a silicone resin powder was added to the silica sol-gel-coated iron powder for producing Example 1, 0.6 mass % of a wax type lubricant was added to the iron powder, and thereby a raw material mixture powder of Example 1 was obtained.

0.03 mass % of a silicone resin powder was added to the silica sol-gel-coated iron powder for producing Example 2, 0.6 mass % of a wax type lubricant was added to the iron powder, and thereby a raw material mixture powder of Example 2 was obtained.

0.18 mass % of a silicone resin powder was added to the silica sol-gel coated iron powder for producing Example 3, 0.6 mass % of a wax type lubricant was added to the soft magnetic powder, and thereby a raw material mixture powder of Example 3 was obtained.

0.03 mass % of a silicone resin powder was added to the silica sol-gel coated iron powder for producing Example 4, and 0.4 mass % of a wax type lubricant was added to the soft magnetic powder, and thereby a raw material mixture powder of Example 4 was obtained.

0.18 mass % of a silicone resin powder was added to the silica sol-gel coated iron powder for producing Example 5, and 0.6 mass % of a wax type lubricant was added to the soft magnetic powder, and thereby a raw material mixture powder of Example 5 was obtained.

Warm molding was performed using the raw material mixture powders of Examples 1 to 5 at a molding pressure of 790 MPa (8 $t/cm^2$) at 80° C., and thereby a ring-shaped molded body was obtained.

The ring-shaped molded body was heated in a nitrogen atmosphere at 650° C. and calcined for 30 minutes to obtain a powder magnetic core. The size of the ring-shaped powder magnetic core was OD 35×ID 25×H 5 mm.

Here, while some components of a coating liquid film coated on the surface of the pure iron powder disappeared due to calcination at 650° C., Si in the liquid film remained as a main component, and formed oxides of Si and Fe or a composite oxide containing Si, Fe, and oxygen, and they remained as a grain boundary layer at grain boundaries between adjacent pure iron powder particles.

In addition, as Comparative Example 1, a sample having a silicone resin film was produced. A coating iron powder was obtained by adding 0.72 mass % of a silicone resin to 300 g of the iron-phosphate-coated pure iron powder (soft magnetic powder) and performing coating, and drying was then performed in an atmosphere. Then, a lubricant was added thereto, molding and a heat treatment were performed, and thereby a ring-shaped molded body sample of Comparative Example 1 was obtained. Molding conditions and heat treatment conditions were the same as conditions in Examples 1 to 5.

As Comparative Example 2, a sample was produced using the same coating solution composition as in Example 4 and under the same conditions as in Example 4 except that a mixing and stirring time of a silicone resin and a solvent was shortened to 30 minutes, a heating temperature after hydrochloric acid and water were added was set to 30° C., and a stirring time was set to 2 hours.

Using the ring-shaped samples obtained as described above, a magnetic flux density (a magnetic field of 10 kA/m), a specific resistance (μΩm), an iron loss (W/kg) at a magnetic flux density of 0.1 T and a frequency of 10 kHz, and a bending strength (MPa) were measured. In addition, an average value (at %) of Fe present in the grain boundary layer was measured.

The magnetic flux density at 10 kA/m of the ring-shaped sample was measured using a B-H tracer (DC magnetization measurement device B integration unit TYPE 3257 commercially available from Yokogawa Electric Corporation). In addition, the iron loss at 0.1 T and a frequency of 10 kHz of the ring-shaped sample was measured using a B-H analyzer (AC magnetic property measurement device SY-8218 commercially available from Iwatsu Electric Co., Ltd.).

The above results are shown in the following Table 1.

TABLE 1

| | Magnetic flux density (10 kA/m) (T) | Specific resistance (μΩm) | Iron loss (W/kg) | Bending strength (MPa) | Fe present in the grain boundary layer (at %) |
|---|---|---|---|---|---|
| Example 1 | 1.2 | $2.0 \times 10^8$ | 18.8 | 39 | 0.4 |
| Example 2 | 0.9 | $7.4 \times 10^8$ | 19.7 | 23 | 1.9 |
| Example 3 | 1.0 | $1.7 \times 10^9$ | 20.7 | 28 | 0.6 |
| Example 4 | 0.7 | $1.8 \times 10^{11}$ | 22.3 | 19 | 2.3 |
| Example 5 | 0.9 | $8.9 \times 10^8$ | 21.4 | 36 | 5.7 |
| Comparative Example 1 | 0.9 | $5.7 \times 10^2$ | 33.4 | 54 | 8.8 |
| Comparative Example 2 | 0.7 | $4.9 \times 10^4$ | 27.2 | 32 | 6.5 |

Based on the results shown in Table 1, it can be understood that the powder magnetic cores of Examples 1 to 5 which were obtained by applying a sol-gel coating solution in which a silicone resin and TEOS were added to a solvent to a soft magnetic powder, performing drying, and then compression molding and calcining had high specific resistance, an excellent magnetic flux density and iron loss, and had excellent soft magnetic properties. In addition, it was found that the powder magnetic cores of Examples 1 to 5 had a sufficient bending strength.

Since all of the powder magnetic cores of Examples 1 to 5 were obtained by calcining at 650° C., it was clearly understood that they had excellent heat resistance, and even if they were heated to about 500 to 650° C., the specific resistance did not decrease as much, and they had excellent soft magnetic properties.

In addition, elemental analysis was performed at 10 places in the grain boundary layer in the cross section of each of the powder magnetic core samples. A value of Fe present in the grain boundary layer was an average value of analysis values at 10 places.

Here, a TEM analysis result of Example 3 to be described below is shown as a specific example. A value of Fe present in the grain boundary layer shown in the other examples and Comparative examples indicates an average value obtained by performing elemental analysis at 10 places. Therefore, in Example 3, an (average) value of Fe present in the grain boundary layer was 0.60 at %.

A content of Fe in the grain boundary layer in Examples 1 to 5 was in a range of 0.4 to 5.7 at %. Focusing particularly on Examples 3 and 5 in which a magnetic flux density at 10 kA/m was the same, and the coating solution composition was the same, it was confirmed that, when a value of an Fe content was higher, the bending strength of the powder magnetic core tended to improve.

Figure 5:
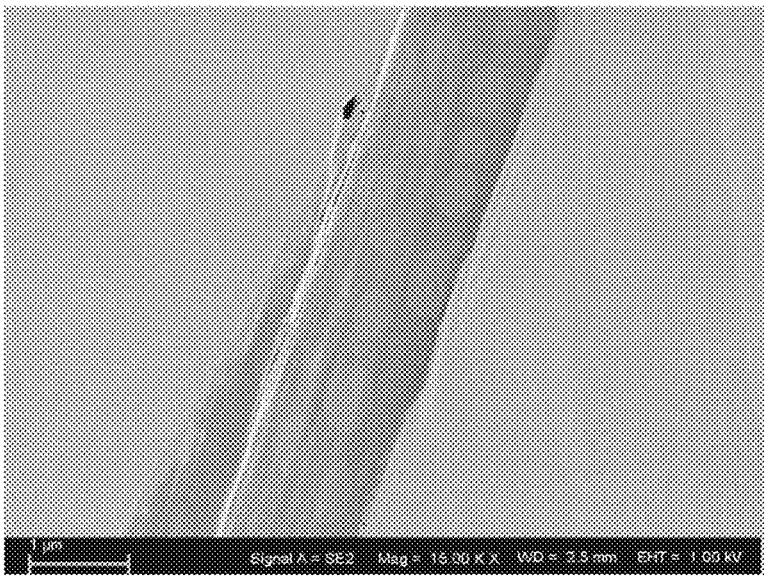
FIG. 5 is a photo of a secondary electron image obtained by capturing a partial cross-sectional structure of a powder magnetic core with silica-based insulating film obtained in an example using a field emission scanning electron microscope at a low acceleration voltage.

FIG. 5 is a photo of a result (SEM secondary electron image) obtained by observing a partial cross-sectional structure of soft magnetic particles including the grain boundary layer of the powder magnetic core of Example 3 described above at a low acceleration voltage using a field emission scanning electron microscope. In addition, FIG. 6 is a photo of an SEM reflected electron image in the same viewing area of the same sample.

As the SEM, Ultra55 (commercially available from Carl Zeiss), and EDS software: NoranSystem Seven were used, and analysis was performed under an observation condition of an acceleration voltage of 1 kV and EDS plane analysis conditions of an acceleration voltage of 4 kV, a current amount of 1 nA, and a WD of 3 mm.

Figure 6:
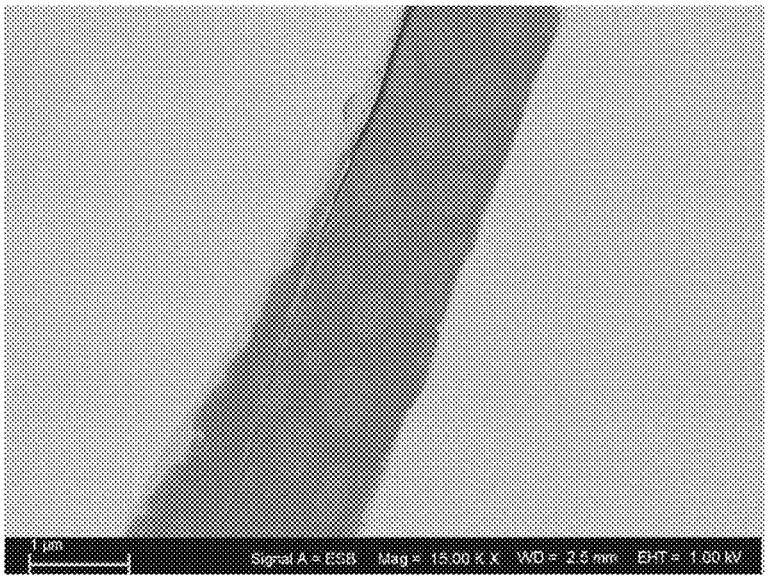
FIG. 6 is a photo of a reflected electron image obtained by capturing the same cross-sectional structure using a field emission scanning electron microscope at a low acceleration voltage.

It can be seen from FIG. 5 and FIG. 6 that a thin iron phosphate coating was formed on the circumferential surface of soft magnetic powder particles, and a grain boundary layer was formed between adjacent soft magnetic powder particles. It can be seen that the grain boundary layer in this example in the view of FIG. 5 and FIG. 6 as an example had a thickness of about 1 to 2 μm. In addition, it can be seen that a shade pattern having a substantially elliptical shape with a maximum diameter of about 0.5 μm was dispersed in some places of the grain boundary layer. Here, it can be understood that a substantially elliptical area with a shade pattern shown in FIG. 5 and FIG. 6 was an area with a low C concentration and an area of $SiO_2$ rich fine particles from the analysis result to be described below.

Figure 8:
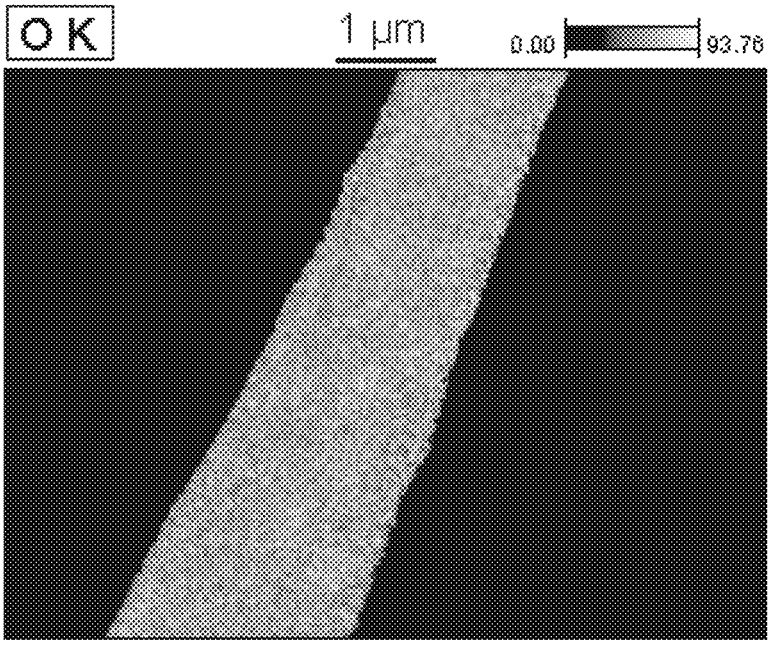
FIG. 8 is an analysis photo showing an oxygen (O) concentration measurement result of the same cross-sectional structure according to SEM-EDS plane analysis.
Figure 9:
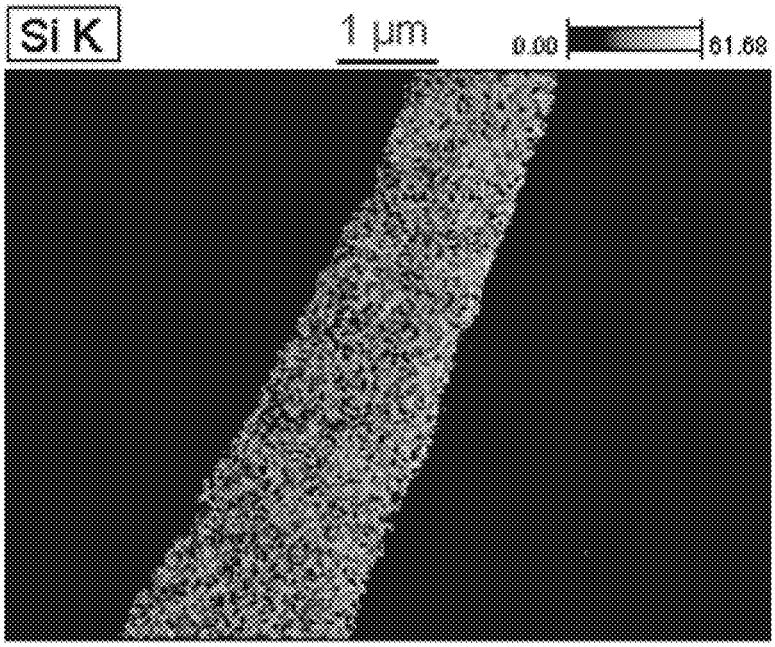
FIG. 9 is an analysis photo showing a silicon (Si) concentration measurement result of the same cross-sectional structure according to SEM-EDS plane analysis.
Figure 10:
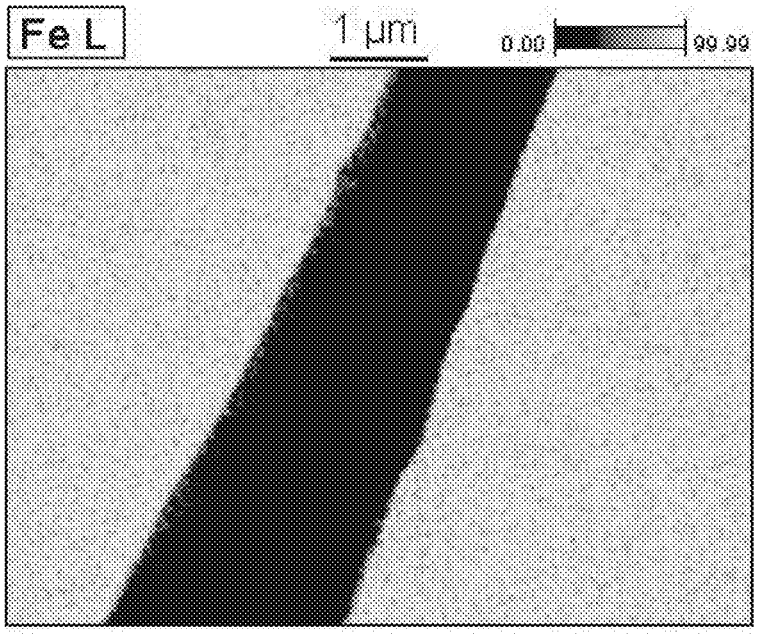
FIG. 10 is an analysis photo showing an iron (Fe) concentration measurement result of the same cross-sectional structure according to SEM-EDS plane analysis.
Figure 11:
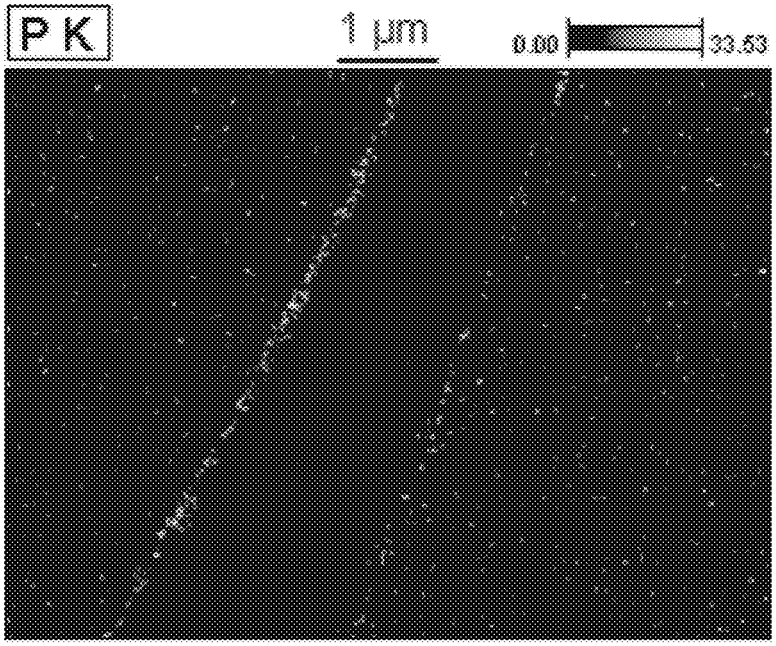
FIG. 11 is an analysis photo showing a phosphorus (P) concentration measurement result of the same cross-sectional structure according to SEM-EDS plane analysis.

FIG. 7 to FIG. 11 are diagrams showing results of EDS plane analysis of SEM observation areas of samples of examples shown in FIG. 5 and FIG. 6. FIG. 7 shows an abundance proportion of C, FIG. 8 shows an abundance proportion of O, FIG. 9 shows an abundance proportion of Si, FIG. 10 shows an abundance ratio of Fe, and FIG. 11 shows an abundance proportion of P.

It can be understood from FIG. 7 that a C concentration in a substantially elliptical area in the grain boundary layer was lower than in the other parts. Accordingly, it can be understood that a substantially elliptical area in the grain boundary layer shown in FIG. 5 and FIG. 6 was an area with a lower C concentration than the other parts.

In FIG. 8, no feature was observed in an oxygen distribution. In FIG. 9, no particular feature was observed in a Si distribution. It can be understood from FIG. 10 that a large amount of iron was present in a soft magnetic powder particle area on both sides of the grain boundary layer and Fe was contained in the iron-phosphate-coated part. In addition, it can be understood from FIG. 11 that much P was distributed in the iron phosphate coating.

Figure 12:
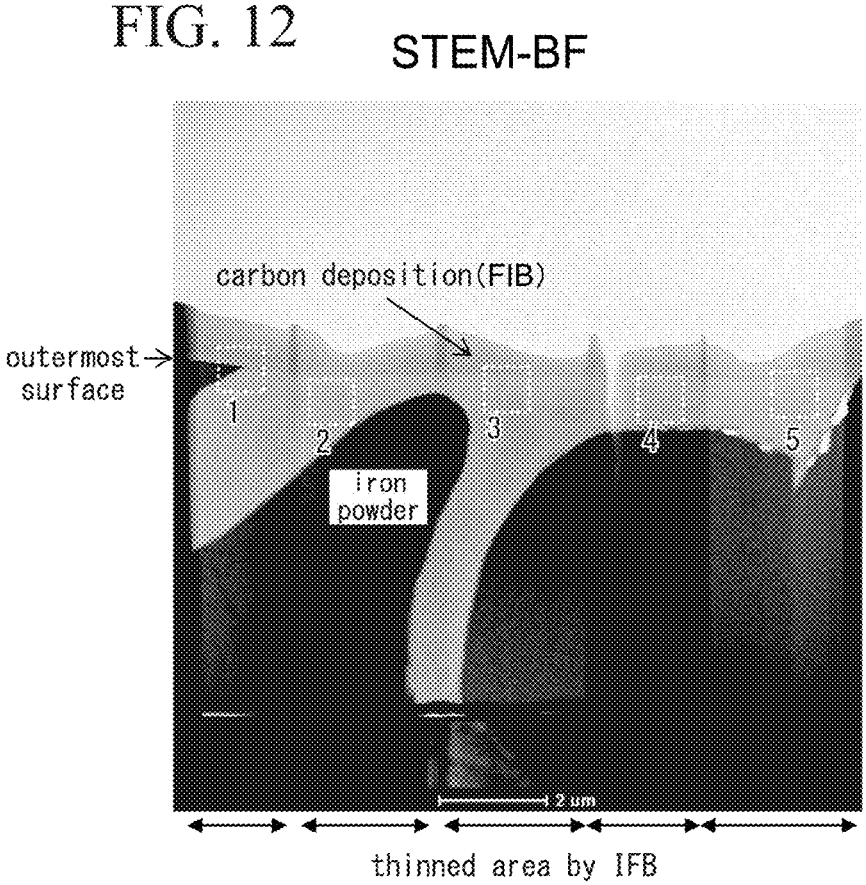
FIG. 12 is a cross-sectional photo showing a part of a sample produced by analyzing a powder magnetic core with silica-based insulating film obtained in an example.

FIG. 12 shows bright field observation results of magnetic powder particles cut out from the sample of Example 3 described above according to focused ion beam device (FIB) processing and the grain boundary layer part therearound under a scanning transmission electron microscope (STEM). A carbon-deposited layer for producing an observation sample was formed above an arrow part indicated as the outermost surface. A round black area indicated as an iron powder was an area of soft magnetic powder particles, and a gray part surrounding the outer circumference of the soft magnetic powder particles corresponded to the grain boundary layer. In the grain boundary layer shown in FIG. 12, EDS analysis was performed on respective rectangular area parts indicated by reference numerals 1, 2, 3, 4, and 5.

Figure 13:
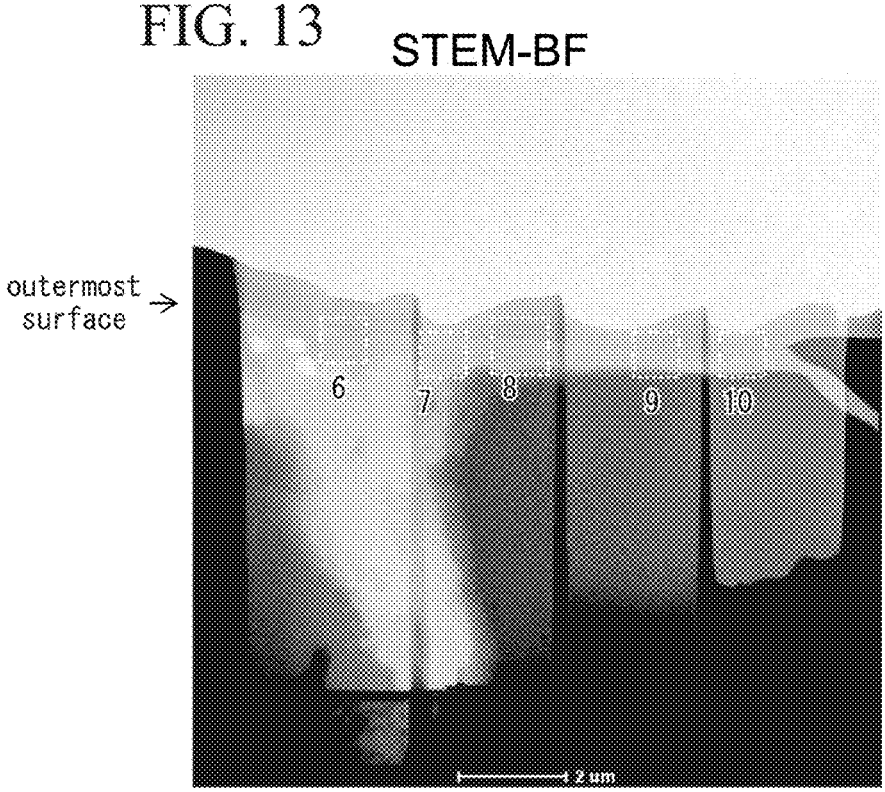
FIG. 13 is a cross-sectional photo showing another part of a sample produced by analyzing a powder magnetic core with silica-based insulating film obtained in an example.

In addition, in the same manner, samples were cut out from other parts of the sample of Example 3, and results of bright field observation under an STEM are shown in FIG. 13. In the grain boundary layer shown in FIG. 13, EDS analysis was performed on rectangular area parts indicated by reference numerals 6, 7, 8, 9, and 10.

As the STEM, Titan G2 ChemiSTEM (commercially available from FBI), and EDS software: Quantax Esprit were used, and analysis was performed under observation conditions of an acceleration voltage of 200 kV. In addition, SMI3050TB (commercially available from Seiko Instruments Inc.) was used as the FIB, and a sample for analysis was produced under processing conditions of a gallium ion of 30 kV.

Figure 14:
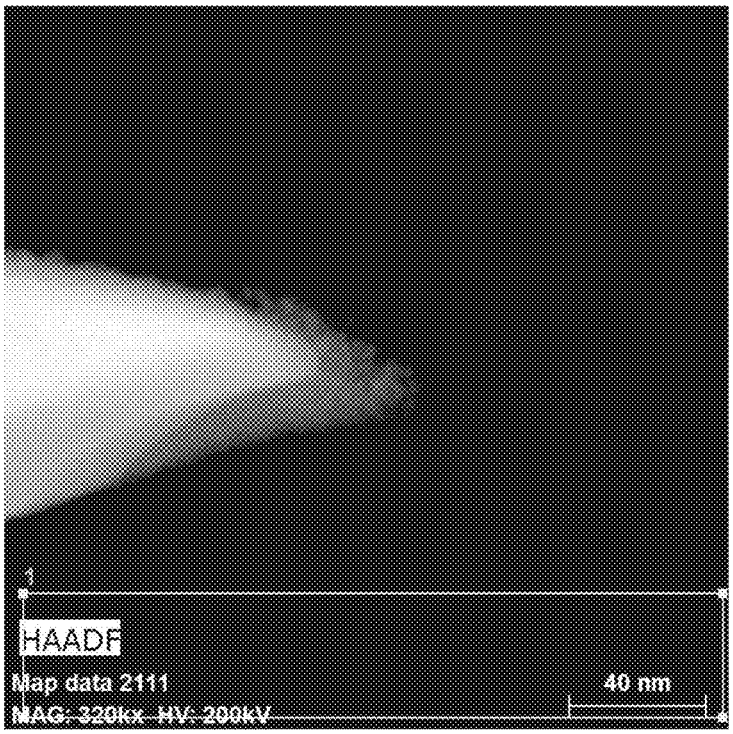
FIG. 14 is a section structure photo obtained by performing analysis (EDS analysis) on an area indicated by the reference numeral 1 in the sample shown in FIG. 12 according to energy dispersive spectroscopy.

FIG. 14 shows a result obtained by analyzing an area indicated by the reference numeral 1 in the sample shown in FIG. 12. A rectangular area was sectioned on the lower side in FIG. 14 and elemental analysis was performed in this section. As a result, there were O: 57.17%, Si: 41.86%, Fe: 0.97% (at %), and the presence of iron was confirmed.

Figure 15:
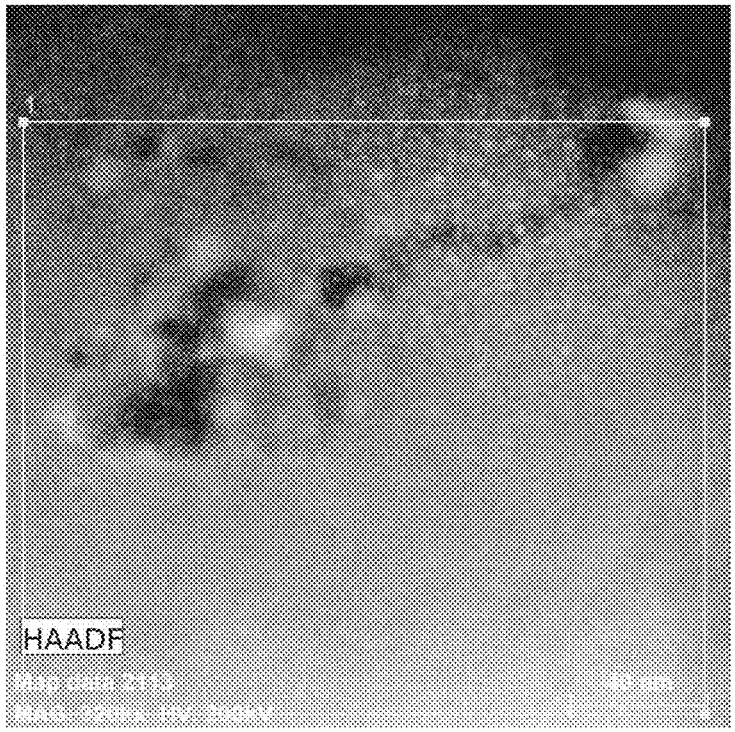
FIG. 15 is a section structure photo obtained by performing EDS analysis on an area indicated by the reference numeral 2 in the sample shown in FIG. 12.

FIG. 15 shows a result obtained by analyzing an area indicated by the reference numeral 2 in the sample shown in FIG. 12. Most of the rectangular area except for the upper end in FIG. 15 was sectioned and elemental analysis was performed in this section. As a result, there were O: 65.36%, Si: 33.94%, P: 0.20%, S: 0.05%, and Fe: 0.44% (at %), and the presence of iron was confirmed.

FIG. 16 shows a result obtained by analyzing an area indicated by the reference numeral 3 in the sample shown in FIG. 12. Most of the rectangular area except for the upper end in FIG. 16 was sectioned and elemental analysis was performed in this section. As a result, there were O: 64.13%, Si: 35.39%, P: 0.11%, S: 0.05%, and Fe: 0.32% (at %), and the presence of iron was confirmed.

FIG. 17 shows a result obtained by analyzing an area indicated by the reference numeral 4 in the sample shown in FIG. 12. Most of the rectangular area in FIG. 17 was sectioned and elemental analysis was performed in this section. As a result, there were O: 64.17%, Si: 35.39%, Fe: 0.40%, and Zr: 0.03% (at %), and the presence of iron was confirmed.

FIG. 18 shows a result obtained by analyzing an area indicated by the reference numeral 5 in the sample shown in FIG. 12. The rectangular area indicating a part of about ⅔ except for the upper part in FIG. 18 was sectioned and elemental analysis was performed in this section. As a result, there were O: 61.29%, Si: 38.35%, Fe: 0.31%, and Zr: 0.06% (at %), and the presence of iron was confirmed.

FIG. 19 shows a result obtained by analyzing an area indicated by the reference numeral 6 in the sample shown in FIG. 13. The rectangular area indicating a part of about ⅔ except for the upper part in FIG. 19 was sectioned and elemental analysis was performed in this section. As a result, there were O: 67.64%, Si: 31.6%, and Fe: 0.76% (at %), and the presence of iron was confirmed.

FIG. 20 shows a result obtained by analyzing an area indicated by the reference numeral 7 in the sample shown in FIG. 13. The rectangular area indicating a part of about ⅔ except for the upper part in FIG. 20 was sectioned and elemental analysis was performed in this section. As a result, there were O: 68.79%, Si: 29.69%, S: 0.07%, Cl: 0.08%, and Fe: 1.37% (at %), and the presence of iron was confirmed.

FIG. 21 shows a result obtained by analyzing an area indicated by the reference numeral 8 in the sample shown in FIG. 13. The rectangular area indicating a part of about ⅔ except for the upper part in FIG. 21 was sectioned and elemental analysis was performed in this section. As a result, there were O: 68.26%, Si: 31.36%, and Fe: 0.38% (at %), and the presence of iron was confirmed.

FIG. 22 shows a result obtained by analyzing an area indicated by the reference numeral 9 in the sample shown in FIG. 13. The rectangular area indicating a part of about ⅔ except for the upper part in FIG. 22 was sectioned and elemental analysis was performed in this section. As a result, there were O: 70.08%, Si: 29.47%, and Fe: 0.44% (at %), and the presence of iron was confirmed.

FIG. 23 shows a result obtained by analyzing an area indicated by the reference numeral 10 in the sample shown in FIG. 13. The rectangular area indicating a part of about ⅔ except for the upper part in FIG. 23 was sectioned and elemental analysis was performed in this section. As a result, there were O: 70.31%, Si: 29.04%, Fe: 0.58%, Zr: 0.05%, and Sn: 0.02% (at %), and the presence of iron was confirmed.

Here, in the elemental analysis results shown in FIG. 16 to FIG. 23, in addition to O, Si, P, and Fe, less than 0.1% of S, Cl, Zr, and Sn was detected. However, since sources of these elements were unknown, they were assumed to be impurities added from the outside when an observation sample was produced.

Based on these results, it was found that, in all parts of the grain boundary layer, there were about 57 to 71% of O, about 29 to 42% of Si and about 0.3 to 1.4% of Fe (at %).

Accordingly, it was clearly understood that Fe diffused from soft magnetic powder particles was present in the grain boundary layer.

Figure 24:
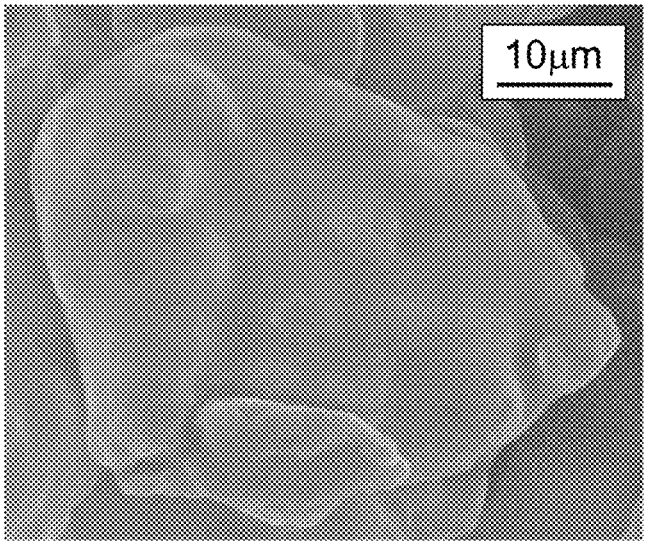
FIG. 24 is an enlarged photo showing an example of a surface state of the silica-based insulation-coated soft magnetic powder obtained in the example.

FIG. 24 is an SEM enlarged photo of a silica sol-gel coated iron powder obtained by heating and drying the iron-phosphate-coated iron powder to which the sol-gel coating solution produced in the previous Example 4 was applied in an atmosphere at 200° C. for 0.5 hours. A magnification was 2,000, and a magnification ratio was set such that one silica sol-gel coated iron powder was within the full SEM image.

Figure 25:
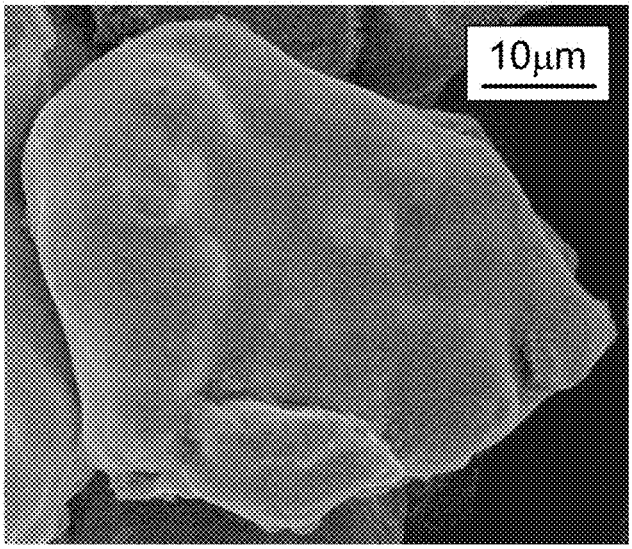
FIG. 25 is an enlarged photo showing a surface state after the silica-based insulation-coated soft magnetic powder obtained in the example was heated in a reduced pressure and inert gas atmosphere at 650° C. for 30 minutes.

FIG. 25 shows an SEM image obtained after this silica sol-gel coated iron powder was subjected to a heat treatment at 650° C. for 30 minutes in a reduced pressure and inert gas atmosphere. Observation was performed using an environmental scanning electron microscope (ESEM, Quanta450FEG commercially available from FEI) at an acceleration voltage of 15 kV according to temperature rise observation.

It was observed that the state of the outer circumferential surface shown in FIG. 25 hardly changed. However, when the state was observed in detail, a fine irregular part was slightly formed on the bottom side of the iron powder outer surface after the heat treatment.

Figure 26:
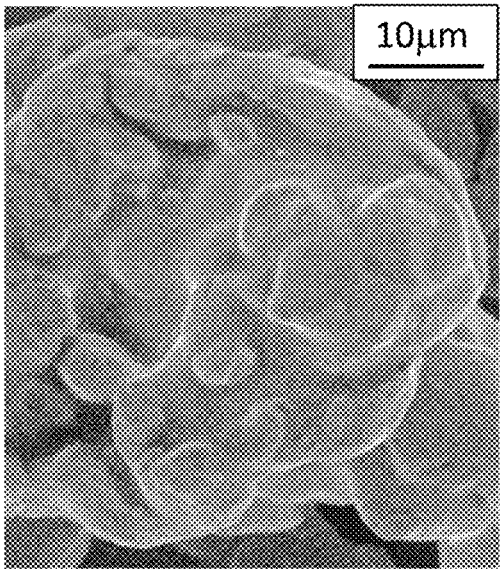
FIG. 26 is an enlarged photo showing an example of a surface state of an insulation-coated soft magnetic powder of the related art.
Figure 27:
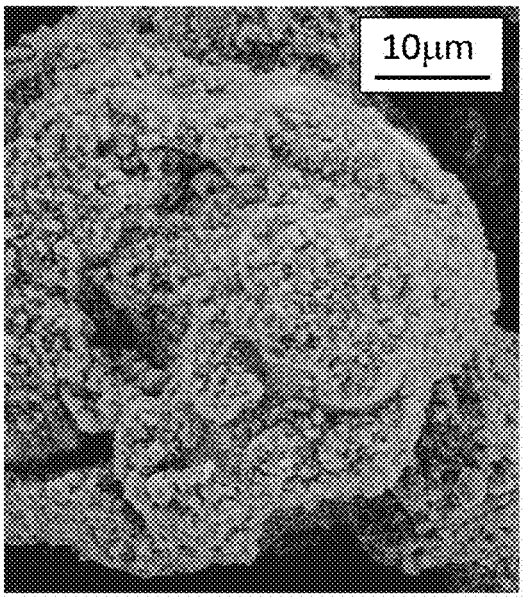
FIG. 27 is an enlarged photo of a surface state after the insulation-coated soft magnetic powder of the related art is heated in a reduced pressure and inert gas atmosphere at 650° C. for 30 minutes.

FIG. 26 shows a silicone resin-coated iron powder of the related art obtained by the same steps as above except that only a silicone resin was added to a solvent instead of the sol-gel coating solution used in Example 4, and TEOS, water, and hydrochloric acid were not added. FIG. 27 shows an ESEM image obtained after this coating iron powder was heated in a reduced pressure and inert gas atmosphere and maintained at 650° C. for 30 minutes using the above ESEM. The state of the outer circumferential surface changed to an extent that can be easily determined, and many fine irregular parts were newly generated on the iron powder outer surface after the temperature was raised.

Such fine irregular parts were formed when iron oxide microcrystals were grown. The fact that many iron oxide microcrystals were generated on the outer circumferential surface of the pure iron soft magnetic powder in this manner means that many defects were generated in the silicone resin film covering the pure iron soft magnetic powder and the number of iron oxide microcrystals was thought to be the same as the number of defects present in the film before the temperature was raised. Since the number of defects present in the film before the temperature was raised cannot be analyzed by a general analysis method, by determining the number of iron oxide microcrystals generated when the temperature was raised in a reduced pressure and inert gas atmosphere, it was possible to estimate the number of defects present in the film before the temperature was raised. Therefore, in the film in which many iron oxide microcrystals precipitated, since there were many defects present in the film before the temperature was raised, it can be estimated that a specific resistance significantly decreased in the powder magnetic core composed of soft magnetic powder particle having this film.

Therefore, since precipitation of iron oxide microcrystals was hardly observed in the silica sol-gel coated iron powder after the temperature was raised shown in FIG. 25, even if the powder magnetic core obtained by consolidating the silica sol-gel coated iron powder before the temperature was raised and performing calcining together with the grain boundary layer was heated to about 650° C., there was a low possibility of the specific resistance being reduced, and thus it can be understood that the powder magnetic core of the present invention had excellent heat resistance.

Figure 28:
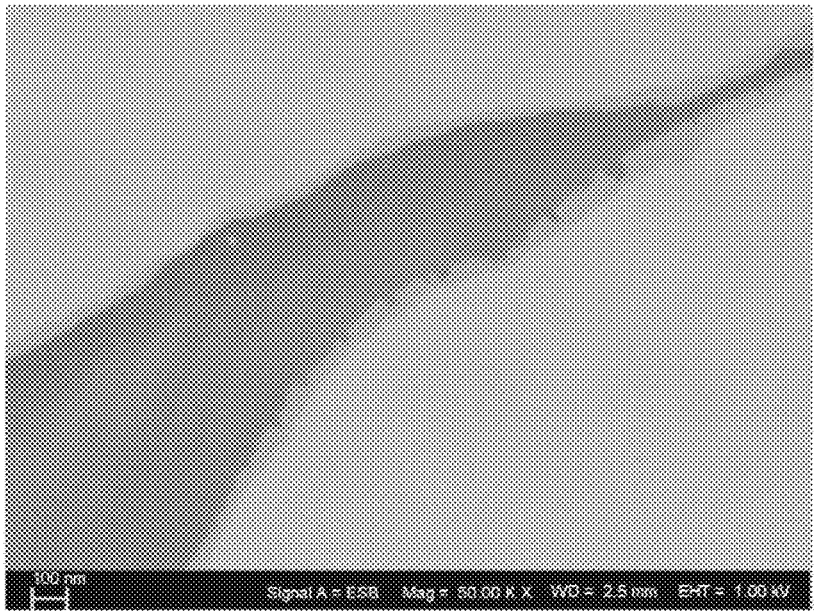
FIG. 28 is a reflected electron image of a part of a grain boundary layer of a powder magnetic core with silica-based insulating film obtained in Example 1 captured using a field emission scanning electron microscope at a low acceleration voltage and a magnification of 50,000.

FIG. 28 shows an enlarged photo of a partial cross-sectional structure of the powder magnetic core with silica-based insulating film of Example 1 and shows a reflected electron image of a part of the grain boundary layer captured using a field emission scanning electron microscope at a low acceleration voltage of (1 kV) and a magnification of 50,000. As described above, this sample was a sample obtained using a raw material mixture powder for molding in which a thickness of a TEOS-derived $SiO_2$ film was 16.9 nm and 0.2 mass % of a silicone resin was contained in a coating solution with respect to the soft magnetic powder and adding 0.09% of a silicone resin powder thereafter. The presence of small spotty $SiO_2$ rich fine particles was confirmed in a very small part of the grain boundary layer.

Figure 29:
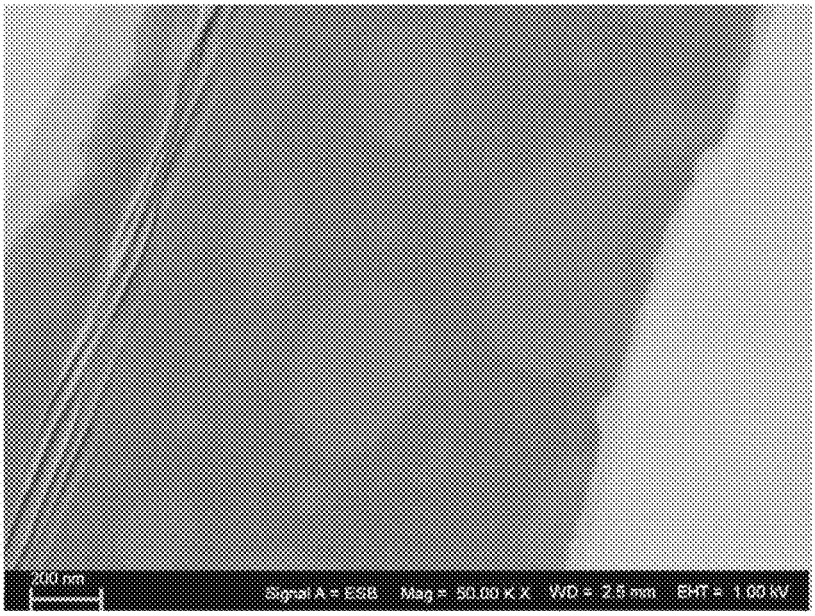
FIG. 29 is a reflected electron image of a part of a grain boundary layer of a powder magnetic core with silica-based insulating film obtained in Example 3 captured using a field emission scanning electron microscope at a low acceleration voltage and a magnification of 50,000.

FIG. 29 shows an enlarged photo of a partial cross-sectional structure of the powder magnetic core with silica-based insulating film of Example 3 and shows a reflected electron image of a part of the grain boundary layer at a low acceleration voltage of (1 kV) and a magnification of 50,000 captured using a field emission scanning electron microscope. As described above, this sample was a sample obtained using a raw material mixture powder for molding in which a thickness of a TEOS-derived $SiO_2$ film was 33.8 nm and 0.18 mass % of a silicone resin was contained in a coating solution with respect to the soft magnetic powder, and adding 0.18% of a silicone resin powder thereafter. The presence of various large and small elliptical and spotty $SiO_2$ rich fine particles in many parts of the grain boundary layer was confirmed.

Figure 30:
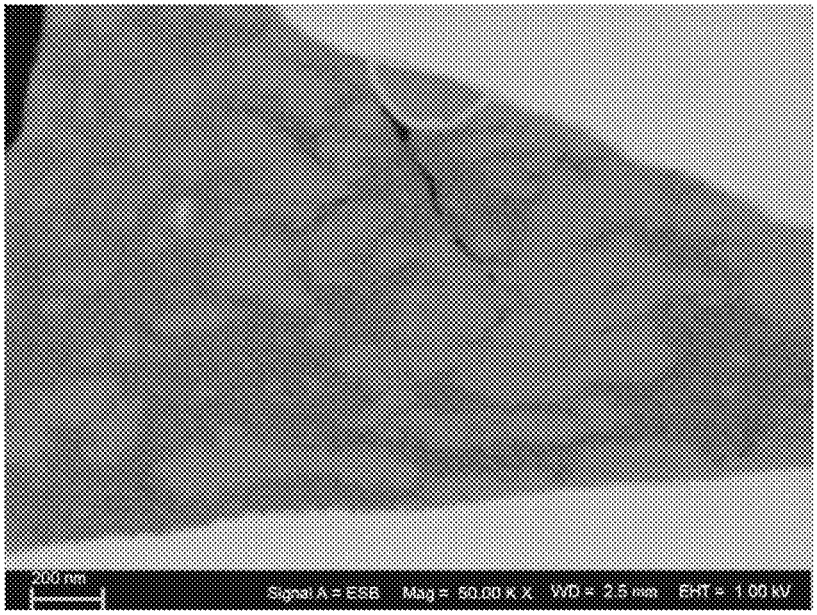
FIG. 30 is a reflected electron image of a part of a grain boundary layer of a powder magnetic core with silica-based insulating film obtained in Example 5 captured using a field emission scanning electron microscope at a low acceleration voltage and a magnification of 50,000.

FIG. 30 shows an enlarged photo of a partial cross-sectional structure of the powder magnetic core with silica-based insulating film of Example 5 and shows a reflected electron image of a part of the grain boundary layer captured using a field emission scanning electron microscope at a low acceleration voltage of (1 kV) and a magnification of 50,000. As described above, this sample was a sample obtained using a raw material mixture powder for molding in which a thickness of a TEOS-derived $SiO_2$ film was 33.8 nm, and 0.41 mass % of a silicone resin was contained in a coating solution with respect to the soft magnetic powder, and adding 0.18% of a silicone resin powder thereafter. The presence of various large and small irregularly shaped $SiO_2$ rich fine particles occupying many parts of the grain boundary layer was confirmed.

Next, in the samples of Examples 1 to 5 and the samples of Comparative Examples 1 and 2 described above, a proportion of $SiO_2$ rich fine particles in the grain boundary layer was obtained by the following method.

For the cross-sectional structure of the powder magnetic core with silica-based insulating film, a reflected electron image of a part of the grain boundary layer captured using a field emission scanning electron microscope at a low acceleration voltage (1 kV) and a magnification of 50,000 was binarized and an area proportion of $SiO_2$ rich fine particles was calculated.

For each of the samples of examples, image analysis was performed on the reflected electron image captured at a magnification of 50,000 in 10 fields of view. A proportion of an area occupied by $SiO_2$ rich fine particles with respect to the total area of the grain boundary layer was divided by the number of fields of view and averaging was performed to obtain an average value of area proportions of $SiO_2$ rich fine particles with respect to the total area of the grain boundary layer.

Regarding the samples of the examples and the samples of the Comparative examples calculated from the above image analysis results, an average value of area proportions of $SiO_2$ rich fine particles with respect to the total area of the grain boundary layer was as follows.

Example 1 (0.26 area %). Example 2 (32.6 area %).
Example 3 (26.4 area %). Example 4 (48.4 area %).
Example 5 (37.6 area %).
Comparative Example 1 (0.00 area %). Comparative Example 2 (4.2 area %).

According to these measurement results, it can be understood that, in the powder magnetic core having high specific resistance, an excellent magnetic flux density and iron loss, excellent soft magnetic properties, and high bending strength as shown in the above Table 1, an average value of area proportions of $SiO_2$ rich fine particles in the grain boundary layer was in a range of 0.26 area % or more and 48.4 area % or less.

That is, it was found that, in the powder magnetic core according to the above example, it was important that an average value of area proportions of $SiO_2$ rich fine particles with respect to the grain boundary layer be 0.2 area % or more and 50 area % or less.

Next, regarding the sample of Example 5, a part of the grain boundary layer was captured under conditions of an acceleration voltage of 4.0 kV and a magnification of 15,000 according to SEM-EDS, one of spotty $SiO_2$ rich fine particles displayed in the captured image was selected, elemental analysis was performed on the fine particle, and elemental analysis was performed on a base layer part away from the $SiO_2$ rich fine particles.

As a result, Si contained in $SiO_2$ rich fine particles of the sample of Example 5 was 44.79 mass %, and Si contained in a base layer part away from $SiO_2$ rich fine particles was 40.91 mass %.

Based on this measurement result, it was clearly understood that a higher concentration of Si was contained in spotty $SiO_2$ rich fine particles than the surrounding base layer part, and spotty fine particles were $SiO_2$ rich fine particles.

INDUSTRIAL APPLICABILITY

It is possible to provide a powder magnetic core having excellent heat resistance which has a structure in which a plurality of Fe-based soft magnetic powder particles are joined with each other through a grain boundary layer formed of a silica-based insulating film therebetween, the grain boundary layer is formed of an oxide of each of Fe and Si or a composite oxide of Fe and Si, Fe diffused from the soft magnetic powder particles is contained in the grain boundary layer, and the grain boundary layer is firmly connected to the soft magnetic powder particles.

In addition, the grain boundary layer covering the soft magnetic powder particles is formed of an oxide of each of Fe and Si or a composite oxide, and the insulation property is excellent even if a heat treatment is performed at a high temperature, and thereby it is possible to provide a powder magnetic core having high specific resistance.

REFERENCE SIGNS LIST

A Powder magnetic core
11 Soft magnetic powder particles
12 Grain boundary layer
12*a* Base layer
12*b* $SiO_2$ rich fine particles
13 Phosphate film (base film)
14 Reactor (electromagnetic circuit component)
14*a* Reactor core
14*b* Coil part

The invention claimed is:

1. A powder magnetic core with silica-based insulating film comprising:

a structure in which a plurality of Fe-based soft magnetic powder particles having surfaces coated with a silica-based insulating film are joined with each other through a grain boundary layer made of the silica-based insulating film, wherein Fe diffused from the Fe-based soft magnetic powder particles is contained in the grain boundary layer having pores of an atomic level in which iron atoms are captured, the grain boundary layer contains an oxide of each of Fe and Si or a composite oxide of Fe and Si, a ratio of Fe with respect to a total amount of Fe, Si and O in the grain boundary layer is 0.1 to 6.0 at %, the grain boundary layer consists of a base layer and $SiO_2$ rich fine particles dispersed in the grain boundary layer, the base layer including oxides of Fe and Si containing C or a complex oxide of Fe and Si containing C, the $SiO_2$ rich fine particles containing C whose content is lower than a C content in the base layer, the $SiO_2$ rich fine particles being detected in an SEM reflected electron image under an observation condition of an acceleration voltage of 1 kV and a magnification of 50,000, said $SiO_2$ rich fine particles being present in a range of 0.2 to 50 area % of the grain boundary layer and the oxides of Fe are diffused in the grain boundary layer.

2. The powder magnetic core with silica-based insulating film according to claim 1, wherein a phosphate coating layer is formed on the surfaces of the plurality of Fe-based soft magnetic powder particles, and the silica-based insulating film is formed outside of the phosphate coating layer.

3. The powder magnetic core with silica-based insulating film according to claim 1, wherein the silica-based insulating film is provided in such a way that the silica-based insulating film directly covers the surfaces of the plurality of Fe-based soft magnetic powder particles.

4. The powder magnetic core with silica-based insulating film according to claim 1, wherein the $SiO_2$ rich fine particles are in an elliptical shape and a maximum diameter of the Si rich fine particles is 0.5 μm.

5. An electromagnetic circuit component formed of the powder magnetic core with silica-based insulating film according to claim 1.

* * * * *